US007455026B2

(12) United States Patent
Towley, III et al.

(10) Patent No.: US 7,455,026 B2
(45) Date of Patent: Nov. 25, 2008

(54) STRUCTURE FOR USE IN BODY OF WATER

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 0 days.

(21) Appl. No.: 11/803,738

(22) Filed: May 15, 2007

(65) Prior Publication Data

US 2007/0277718 A1 Dec. 6, 2007

Related U.S. Application Data

(63) Continuation of application No. 11/301,264, filed on Dec. 12, 2005, now Pat. No. 7,216,603, which is a continuation-in-part of application No. 11/175,998, filed on Jul. 6, 2005, now Pat. No. 7,216,602, which is a continuation-in-part of application No. 11/150,048, filed on Jun. 10, 2005, now Pat. No. 7,273,019.

(51) Int. Cl.
*B63C 13/00* (2006.01)

(52) U.S. Cl. ..... 114/344; 114/263; 280/414.1

(58) Field of Classification Search ..... 114/44, 114/45, 263, 264, 266, 267, 344; 135/97; 280/414.1; 414/494, 495
See application file for complete search history.

(56) References Cited

U.S. PATENT DOCUMENTS 2,887,975 A 5/1959 Smith
3,065,721 A 11/1962 Roudabush
3,126,855 A 3/1964 Freeburg
3,626,447 A 12/1971 Hindlin
3,857,352 A 12/1974 Schott
3,895,592 A 7/1975 King
4,084,529 A 4/1978 Katernberg
4,092,755 A 6/1978 Hughes
5,131,342 A 7/1992 Sackett
5,478,166 A 12/1995 Starr
6,058,869 A 5/2000 Thon
6,131,528 A 10/2000 Meek
6,520,102 B1 2/2003 Johnson
7,216,602 B2 * 5/2007 Towley et al. ..... 114/344
7,216,603 B2 * 5/2007 Towley et al. ..... 114/344
7,273,019 B2 * 9/2007 Towley et al. ..... 114/344

OTHER PUBLICATIONS

Float-N-Go Brochure (undated but admitted prior art).
Floatation Systems Brochure (undated but admitted prior art).

* cited by examiner

*Primary Examiner*—Lars A Olson
(74) *Attorney, Agent, or Firm*—James W. Miller

(57) ABSTRACT

A structure can be installed in and removed from a body of water in a seasonal fashion. The structure has a lower level that includes a boat lift and may include an upper level that provides an entertainment area. The structure carries a buoyancy system for selectively floating the structure on the body of water or sinking the structure in the water. A substantially enclosed boathouse may form the structure when the structure has only a lower level. The boathouse is separable into sections each of which could be separately rolled over the ground by wheels attached to each section. This reduces the usual operational width of the boathouse into the smaller towed widths of the individual sections to ease the task of transporting the boathouse over the ground.

15 Claims, 20 Drawing Sheets

STRUCTURE FOR USE IN BODY OF WATER

CROSS REFERENCE TO RELATED APPLICATIONS

This application is a continuation of application Ser. No. 11/301,264 filed Dec. 12, 2005, now U.S. Pat. No. 7,216,603, which is a continuation-in-part of application Ser. No. 11/175,998 filed Jul. 6 2005, now U.S. Pat. No. 7,216,602, which is a continuation-in-part of application Ser. No. 11/150,048 filed Jun. 10, 2005 now U.S. Pat. No. 7,273,019.

TECHNICAL FIELD

This invention relates to a structure used in a body of water such as a lake. More particularly, this invention relates to a structure that is installed in and removed from the body of water in a seasonal fashion, i.e. installed in and used in the body of water during the spring and summer and removed from the body of water and stored on land during the fall and winter.

BACKGROUND OF THE INVENTION

The recreational boating industry involves the use of a watercraft, such as a jet ski or boat, on a body of water. Many different structures have been developed to facilitate the use of and enjoyment of such watercraft. One such structure is a boat lift and an adjoining dock. The boat lift includes a movable cradle that may be raised and lowered to lift the watercraft into a storage position out of contact with the water or drop the watercraft into a use position in which the watercraft floats on the water. The cradle of the boat lift may be powered either manually or by some type of motor.

In northern locales where the body of water freezes during the winter, boat lifts and docks are typically used seasonally. Usually, a boat lift/dock is installed in the body of water in the spring and used throughout the summer. Then, prior to the onset of cold weather in the late fall, the boat lift/dock is removed from the body of water and stored on land during the winter. This prevents the boat lift/dock from being damaged by ice formed in the body of water during the winter.

Installing and removing a boat lift or dock from a body of water is often a very strenuous and difficult operation. While docks come in sections to allow a dock to be disassembled and removed piece by piece, the same is not true of a boat lift. A boat lift is typically provided as one assembled, unitary structure. Thus, a boat lift often has to be manhandled into and out of the water using brute force. This usually requires a number of strong, fit people who often must be specifically hired for the job.

The boat lift installation and removal problem is made even worse if the shorefront property over which the boat lift must travel to the body of water is steep, rocky or uneven or the beach is narrow or non-existent. Most prime shorefront property having relatively wide, smooth and flat beaches has already been developed. Thus, owners of more newly developed shorefront property may have an impossible time of installing and removing a boat lift or dock from the water. It often can't be done if there is a large drop or highly uneven terrain between where the boat lift or dock must be stored out of season and where the boat lift or dock is to be installed and used during the season.

In addition, some boat lifts are part of larger, multi-level structures that include an entertainment area, such as a patio or sundeck, in a second level located above the boat lift. Obviously, such multi-level structures are considerably heavier and more complex than a boat lift or dock alone. To date, such multi-level structures are only used in climates where they can be assembled in place in the body of water and left year round. Thus, the use of such multi-use, multi-level structures has been restricted to bodies of water that remain open and ice free year round.

There is a need in this art for a simpler, easier way of installing and removing structures such as boat lifts and docks from a body of water. In addition, there is a need to find some way of being able to install and remove a multi-use, multi-level structure from a body of water without having to assemble and disassemble such structure in place. This invention addresses these and other needs.

SUMMARY OF THE INVENTION

One aspect of this invention relates to a structure that may be used in a body of water. The structure has at least a first level. At least a pair of wheels can be at least temporarily attached to the structure to allow the structure to be transported by ground by rolling the structure over the ground. A buoyancy system is carried on the structure to selectively provide the structure with a buoyant state in which the structure floats on the body of water and a non-buoyant state in which the structure does not float on the body of water.

BRIEF DESCRIPTION OF THE DRAWINGS

This invention will be described more completely in the following Detailed Description, when taken in conjunction with the following drawings, in which like reference numerals refer to like elements throughout.

FIG. 30 is a diagrammatic top plan view similar to FIG. 28, but particularly showing an alternative boathouse in which the boathouse and the boat lifting cradle are split into a plurality of transverse modules that are assembled end to end to make the complete boathouse;

FIG. 31 is a diagrammatic top plan view of the alternative structure shown in FIG. 30, particularly illustrating the ballast tank placement in the individual boathouse modules.

DETAILED DESCRIPTION

Figure 1:
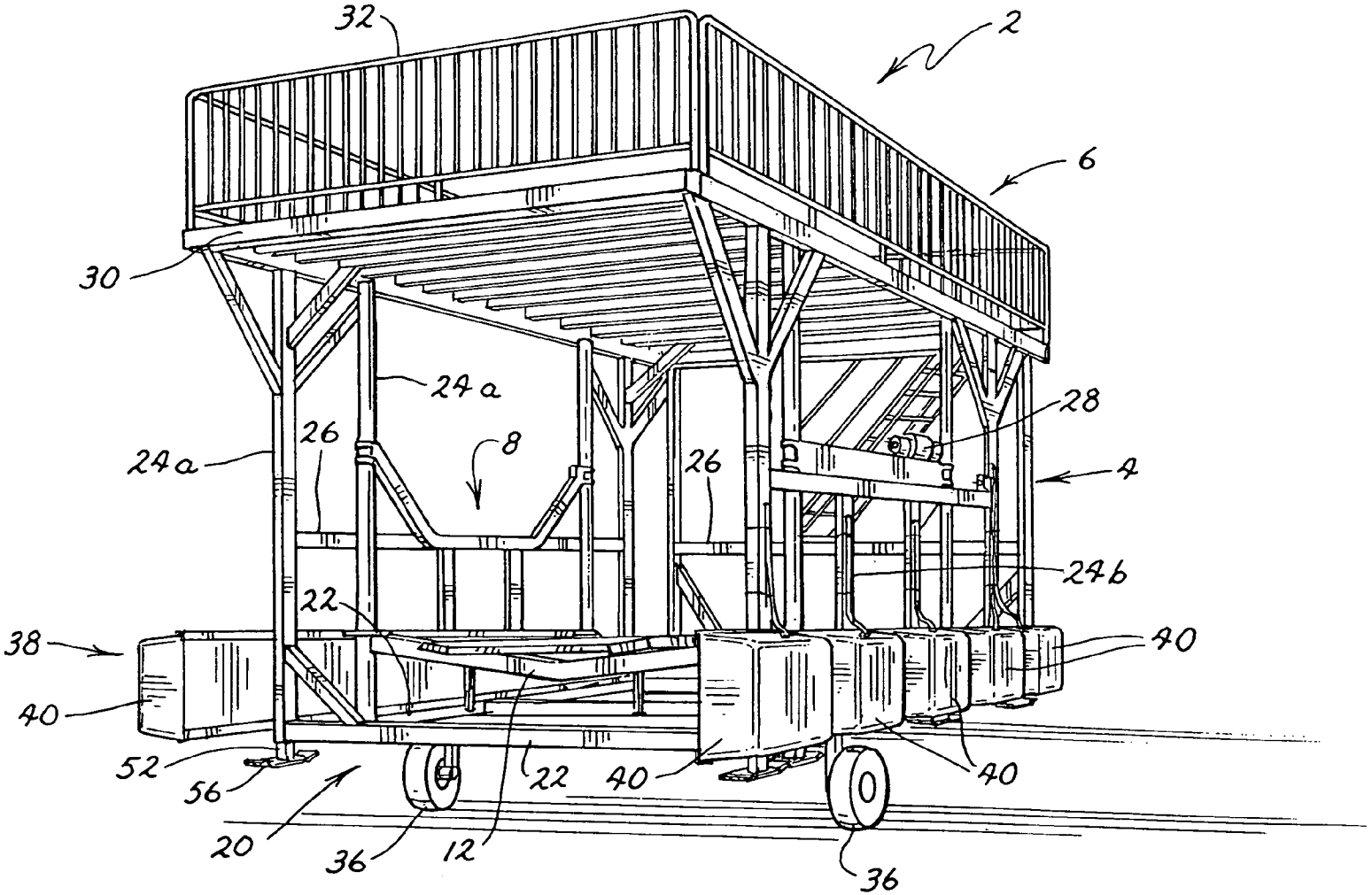
FIG. 1 is a perspective view of a first embodiment of a structure according to this invention, particularly illustrating a multi-level structure providing a boat lift on the lower level and an entertainment area on the upper level, the structure being shown disposed on the ground for ground transport.

One embodiment of a structure according to this invention is shown in FIG. 1 generally as 2. Structure 2 preferably has two stories or levels comprising a lower level 4 and an upper level 6. Lower level 4 preferably contains a vertically movable boat lift 8 for holding a watercraft such as a boat 10 or jet ski. Lower level 4 is open along a rear end to allow boat 10 to be driven from a body of water into lower level 4 of structure 2 and positioned atop a cradle 12 of boat lift 8.

Figure 2:
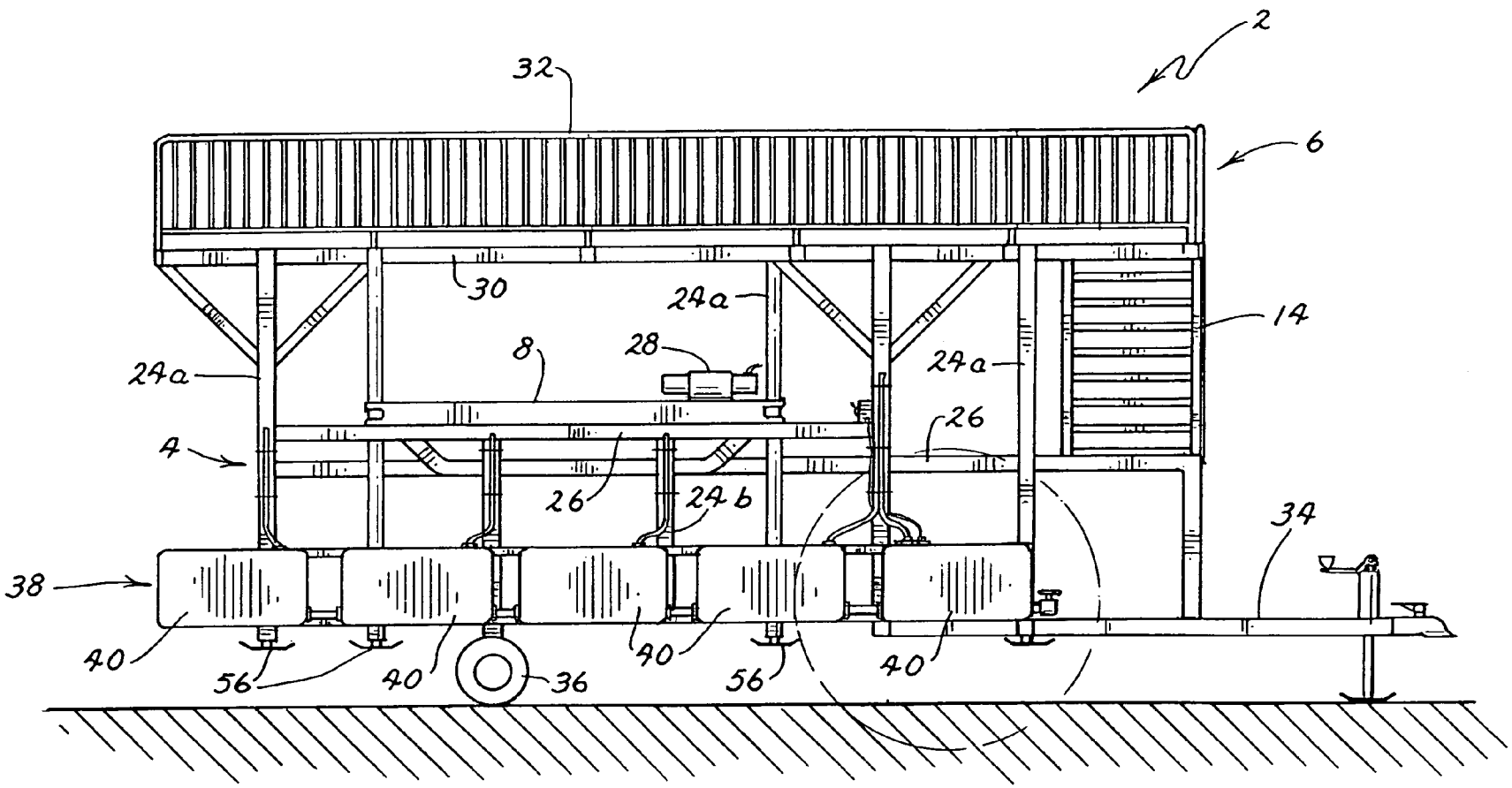
FIG. 2 is a side elevational view of the structure shown in FIG. 1.
Figure 3:
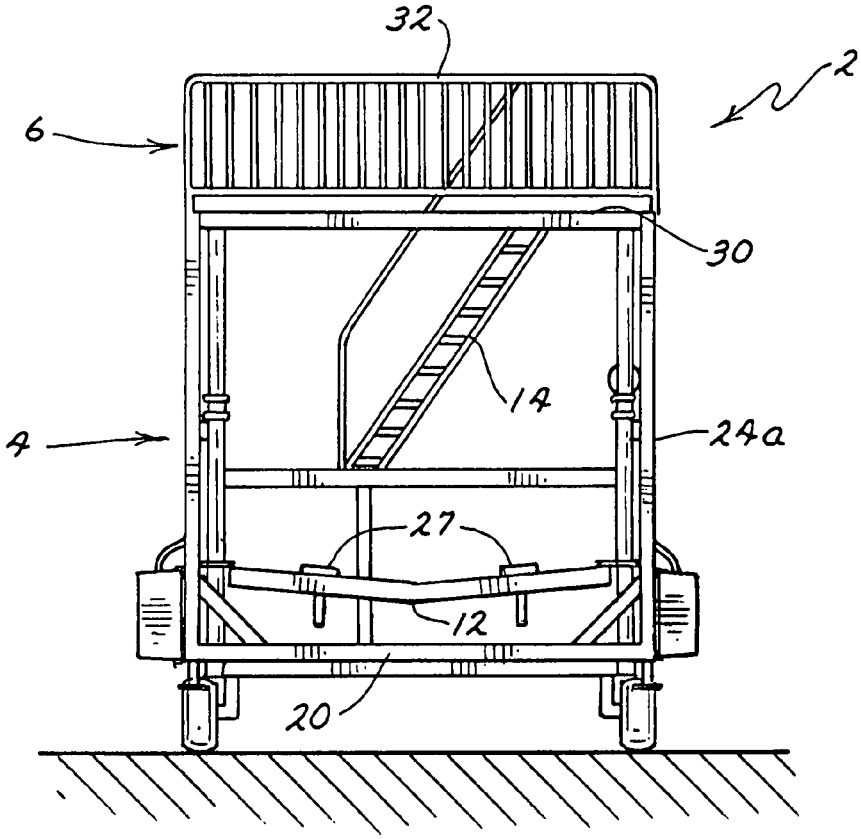
FIG. 3 is a rear elevational view of the structure shown in FIG. 1.
Figure 6:
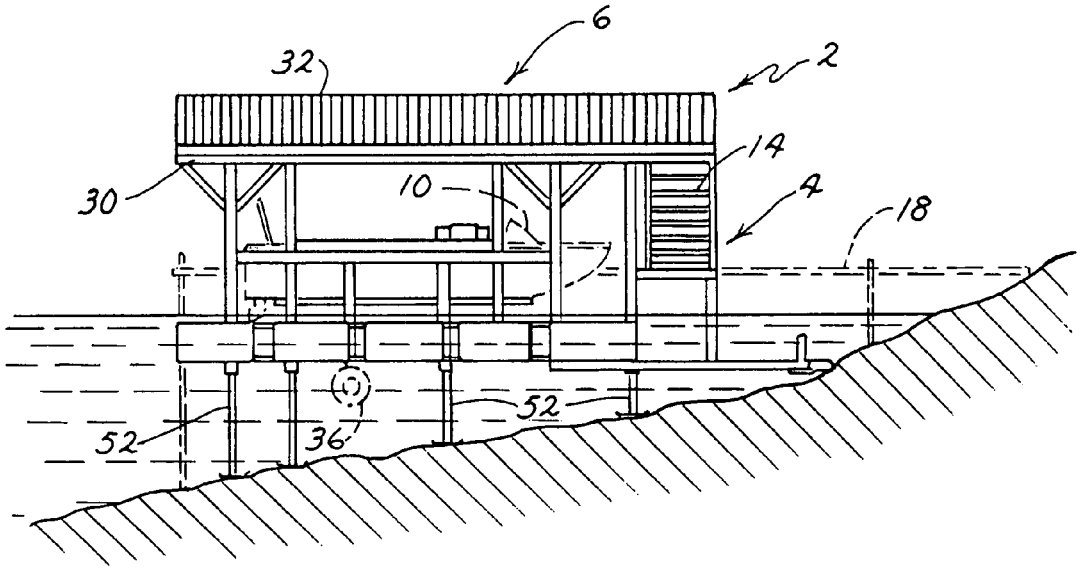
FIG. 6 is a side elevational view similar to FIG. 5, but illustrating the structure having been sunk into the bottom of a body of water adjacent a shoreline, the ballast system having been filled with water to provide ballast for the structure.

Upper level 6 preferably provides an entertainment area for people and their guests. Structure 2 includes a stairway 14 at the front end for allowing people to ascend to the entertainment area provided by upper level 6 of structure 2. Stairway 14 can extend down only a portion of the height of lower level 4 as shown in FIG. 2. This allows the bottom of stairway 14 to mate with a landing or dock 18 extending from the shoreline at an elevation above the base 20 of lower level 4 as shown in FIG. 6.

Lower level 4 has a substantially rectangular base 20 formed as an open framework by a plurality of longitudinal and transverse beams 22 that are rigidly connected together by being welded or bolted together. Base 20 comprises an open framework. By this, it is meant that base 20 is open to the passage of water and lacks a hull or solid bottom that would permit direct flotation of structure 2. Thus, without the ballast system 38 of this invention whose operation will be described hereafter, structure 2 would otherwise sink when placed into a body of water.

Lower level 4 of structure 2 is formed by a plurality of uprights 24 that extend vertically upwardly from base 20 along the peripheral sides of base 20. Some of the uprights 24*a* extend full height to upper level 6 of structure 2. Other uprights 24*b* extend only a few feet up from base 20. Side rails 26 can extend between uprights 24*a* and over the tops of partial height uprights 24*b* to form partial height, open side walls along three sides of lower level 4. No partial height side wall is present at the open rear end of lower level 4 to allow a boat to be driven into lower level 4 and to have access to boat lift 8.

A standard boat lift 8 is housed in lower level 4 of structure 2. Boat lift 8 comprises a V-shaped cradle 12 having a plurality of rollers or pads 27 for engaging against the hull of a boat 10. See FIGS. 11 and 12. Cradle 12 vertically slides up and down on some of the full height uprights 24*a* of structure 2. A lifting apparatus 28, such as an electrically powered or hand powered winch, lifts and lowers cradle 12 from a lowered watercraft receiving position to a raised watercraft storage position shown in FIG. 6. Such boat lifts 8 are well known in the boating industry and need not further be described herein.

Upper level 6 of structure 2 comprises a weight bearing floor or deck 30 supported by the upper ends of the full height uprights 24*a*. A safety railing 32 is preferably provided around the periphery of deck 30 to prevent people and objects from falling off deck 30. Stairway 14 provides access to deck 30 and may join deck 30 through an opening (not shown) in deck 30. Obviously, people can ascend stairway 14 to be able to pass through such opening and gain access to deck 30. Alternatively, stairway 14 could be placed along one side of deck 30 with access to deck 30 being provided through an opening in safety railing 32.

Deck 30 which forms upper level 6 of structure 2 provides an entertainment area in which people, such as the owners of structure 2 and their guests, may gather for entertainment. Deck 30 is sufficiently strong to bear the weight of various people standing thereon along with pieces of furniture (e.g. patio chairs, tables, etc.) or entertainment equipment (e.g. barbecues, stereos, etc.) carried thereon. Play equipment suited for water recreation (e.g. diving boards, water slides, ropes, etc.) can be attached to the sides of deck 30 and/or extended out from deck 30. In addition, all or part of deck 30 could be covered with a removable roof or canopy (not shown) to help protect the people using deck 30 from the elements. Thus, upper level 6 of structure 2 provides a conveniently located entertainment area that complements the outdoor, water based environment in which structure 2 is used.

Base 20 includes a tow hitch and a pair of ground engaging wheels 36 to allow structure 2 to be towed over the ground, such as over a road or the like. The tow hitch comprises a tow tongue 34 that extends from the front end of base 20 of lower level 4 of structure 2. Tow tongue 34 is connected in any suitable manner, i.e. by a ball and socket hitch, to a tow vehicle (not shown), such as a pickup truck, SUV, or the like.

Wheels 36 are rotatably carried on the underside of base 20 of lower level 4 by any suitable axle and bearing structure. Wheels 36 and their associated axles and bearings are all rated for highway use. Wheels 36 can be permanently mounted on base 20. However, wheels 36 are preferably of a removable type to allow wheels 36 to be selectively installed on and removed from base 20. This removal is indicated in FIG. 6 by the phantom line illustration of wheels 36.

Preferably, wheels 36 are the usual pneumatic type rubber wheels that are typically used on cars and on boat trailers with wheels 36 being inflated by air. This allows structure 2 to be towed at reasonably high towing speeds, such as 25 to 35 mph, that are substantially above walking speeds. Thus, if structure 2 is towed at such speeds, then structure 2 will not impede the flow of traffic at least on most non-freeway type roadways. In addition, such wheels 36 allow structure 2 to be towed over long distances if need be.

Structure 2 preferably includes a ballast system 38 that provides positive buoyancy for structure 2 when ballast system 38 is completely or even partially empty of water, but that provides sufficient weight to structure 2 to substantially anchor structure 2 in place in a body of water when ballast system 38 is full of water. In addition, ballast system 38 can be partially filled with water to any desired degree to provide a desired mix of buoyancy and weight such that structure 2 can be stably transported across a body of water. For example, given the relatively top heavy nature of structure 2, ballast system 38 might always be at least partially filled with water to provide enough weight to prevent structure 2 from capsizing or being blown over while structure 2 is floating or being transported on the water. The amount of ballast weight provided by ballast system 38 can be easily adjusted by adding water to ballast system 38 to take into account any environmental conditions that might be present, such as high winds on the body of water.

Ballast system 38 comprises a plurality of substantially rigid, hollow ballast tanks 40, made from either metal or a strong, durable plastic material, secured as low as possible to lower level 4 of structure 2. As shown in FIGS. 1-5, ballast system 38 can comprise a horizontal row of five tanks 40 along one side of lower level 4 of structure 2. A similar row of five tanks 40 is disposed along the opposite side of lower level 4 of structure 2. Each row of tanks 40 is secured to lower level 4 of structure 2 substantially adjacent base 20 of lower level 4.

Each row of tanks 40 is preferably outboard of each side of lower level 4 of structure 2 to not intrude into the space occupied by boat lift 8. Each individual tank 40 is rectangular but could have other shapes. Tanks 40 within each row are oriented generally vertically to minimize the width of structure 2 when tanks 40 are in place thereon. See FIGS. 1 and 3 which illustrate the outboard, vertical orientation of tanks 40. Tanks 40 can be secured to structure 2 in any suitable manner, e.g. by strapping tanks 40 to the sides of structure 2, etc.

Figure 4:
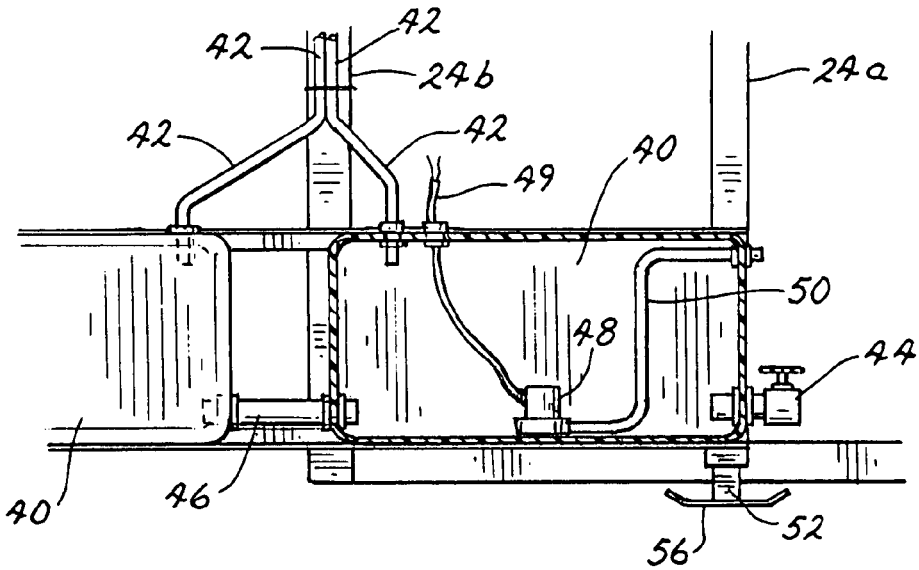
FIG. 4 is a side elevational view, partly shown in cross-section, of a portion of the ballast system of the structure shown in FIG. 1, particularly illustrating a pair of interconnected ballast tanks and a bilge pump inside one of the tanks for pumping water out of the interconnected ballast tanks.

Referring now to FIG. 4, each individual tank 40 of ballast system 38 includes an air vent comprising an upwardly extending snorkel tube 42. The lower end of tube 42 enters into the top of tank 40. The upper end of tube 42 extends upwardly along the side of lower level 4 and is secured to one of the uprights 24. Tube 42 is long enough so that the upper end of tube 42 remains above the water line even when ballast system 38 is completely filled with water and structure 2 has sunk to its maximum depth in a body of water.

Referring further to FIG. 4, one ballast tank 40 in each row has a hand operated fill valve 44 in one end thereof. In addition, all tanks 40 in each row are interconnected or plumbed together by a plurality of hydraulic couplings 46 with one coupling 46 extending between and interconnecting each two adjacent tanks 40. Thus, from a hydraulic standpoint, the individual tanks 40 in each row of tanks act collectively act as a single long tank and, in fact, could be replaced by such a single tank. However, it is more practical and economical to join a plurality of smaller tanks 40 together along each side of structure 2 than to use one long tank.

One tank 40 in each row of tanks has an electrically operated bilge pump 48 installed in the bottom of tank 40 as shown in FIG. 4. Bilge pump 48 is coupled to a drain line 50 that is routed out through the side of tank 40 adjacent the top of tank 40. Drain line 50 is sealed where it passes through the wall of tank 40 to prevent water from leaking into tank 40 around drain line 50. The only path for water to enter ballast system 38 is through the manually operated fill valve(s) 44.

Bilge pump 48 is powered by an electrical supply line 49 that brings electrical power to bilge pump 48 from a source of electrical power. Preferably, this electrical power source is carried on structure 2 and comprises a simple battery placed somewhere on structure 2, i.e. on deck 30 of upper level 6. This battery could be rechargeable using solar power. Alternatively, the source of electrical power could be external to structure 2, such as a battery on a boat or a land based electrical power line extending to structure 2.

To fill each row of ballast tanks, the user need only manually open fill valve 44 to allow water to flow into tanks 40 on that side of structure 2. Desirably, fill valves 44 on both rows of ballast tanks are opened at the same time to allow the dual rows of ballast tanks to fill evenly. As water enters each row of ballast tanks, the water will fill all tanks 40 in each row in an even progressive manner due to the interconnecting couplings 46 between tanks 40. The air vents 42 provided in the tops of tanks 40 allow air to escape from tanks 40 during the tank filling process. When tanks 40 have been filled to a desired amount, the user need only close fill valves 44 by turning the handle on each fill valve 44 to a closed position.

Conversely, to empty each row of ballast tanks, the user need only energize bilge pump 48 for that row of tanks using any suitable switch or control (not shown) in the electrical supply to bilge pump 48. Bilge pumps 48 in the dual rows of ballast tanks desirably have identical pumping rates. In addition, bilge pumps 48 are preferably actuated at the same time so that water is pumped out of each row of ballast tanks at the same rate and at the same time. To ensure bilge pumps 48 are always activated at the same time, a single control or switch could be wired into the electrical supply circuits to both pumps so that they both operate together whenever the control or switch is selectively closed by the user.

Preferably, each bilge pump 48 will pump water out of whatever tank 40 in which it is contained at a rate that is less than the rate at which water can flow through the interconnecting couplings 46. Thus, water within the row of tanks will lower in a steady, even fashion, i.e. tank 40 containing bilge pump 48 is not pumped dry ahead of the other tanks in the same row. This is done by oversizing the hydraulic couplings 46 relative to the size of drain line 50 and the pumping rate of pump 48.

Structure 2 provided by this invention can be easily installed in a body of water or removed from a body of water to allow seasonal use even though structure 2 is a multi-level structure. For example, assume that it is spring and structure 2 has been stored out of the water on land as is necessary in northern climates where the body of water in which structure 2 is normally used freezes. In this condition, wheels 36 are in place on base 20. At some point during the spring, the body of water will thaw and the user of structure 2 will decide to put structure 2 into the water.

To put structure 2 in the water, the user need only connect a tow vehicle to tow tongue 34. The vehicle is then used to tow structure 2 to the body of water in which it is be installed. The use of conventional pneumatic, rubber wheels 36 and a conventional hitch allows structure 2 to be towed over at roadway at normal non-freeway type speeds. Once the user reaches the body of water, the user can then back structure 2 into the water. This can be done either proximate to where structure 2 is to be installed in the body of water, i.e. on the user's own property, or remotely from where structure 2 is to be installed, i.e. at a boat ramp that may be remote from the user's own property such as a boat ramp located on the other side of the lake.

Of course, when structure 2 is first backed into the water during the spring, tanks 40 in ballast system 38 will be largely or completely dry since structure 2 has been out of the water over the winter. Thus, structure 2 upon entering the water will be naturally buoyant without having to do anything since the dry tanks 40 will provide their maximum buoyancy. If structure 2 is situated at its final desired location immediately upon entry into the water, fill valves 44 may be used to completely flood tanks 40. However, some amount of final positioning or even extended transport over the body of water may often be required. Thus, the user will preferably open fill valves 44 on ballast system 38 and partially flood tanks 40 on either side of structure 2 until some water enters tanks 40 and provides some stability to structure 2 but structure 2 as a whole is still buoyant.

Figure 5:
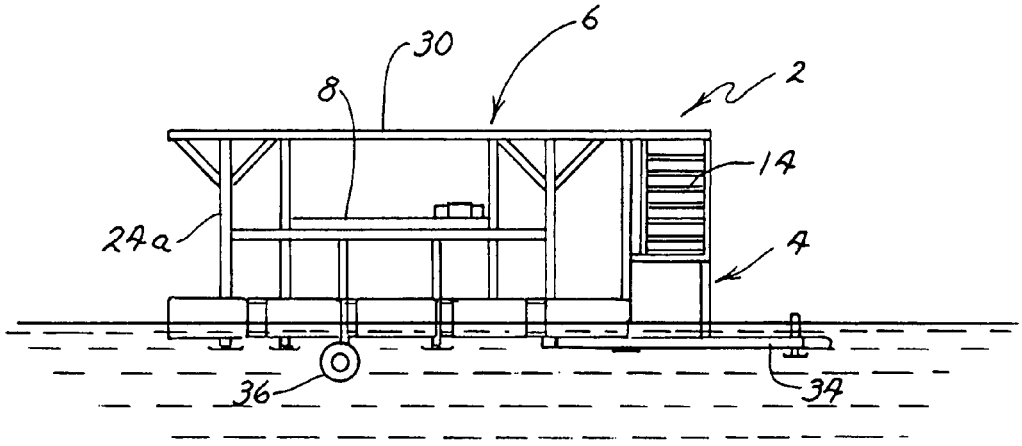
FIG. 5 is a side elevational view of the structure shown in FIG. 1, particularly illustrating the structure floating on water for water transport, the ballast system providing a desired amount of buoyancy for such water transport.

With a partially flooded ballast system 38, structure 2 will still float on the water but will have sufficient stability to allow structure 2 to be accurately positioned. For example, the user can then push or pull on structure 2 to float it however many feet or yards is required until structure 2 is positioned exactly where it is to be installed. If structure 2 has been put into the body of water at a remotely located boat ramp, then structure 2 may have to be towed across the body of water to reach its destination and then positioned by hand. In either case, the use of partially flooded ballast tanks 40 allows such water transport to occur, either over short or long distances. FIG. 5 illustrates structure 2 in this condition floating on a body of water.

Once structure 2 has been exactly positioned where the user likes, then fill valves 44 can be opened again and ballast system 38 completely flooded to provide the maximum ballast weight to structure 2. This will sink structure 2 in the body of water to the maximum possible depth as shown in FIG. 6. In this condition, at least some of lower level 4 of structure 2 up as far as the top of tanks 40 will be submerged Ideally, however, legs 52 (described hereafter) will be adjusted so that the tops of tanks 40 are somewhat below the water surface when structure 2 is resting on the bottom to prevent tanks 40 from collecting waterborne debris. This is shown in FIG. 6.

The amount of weight added by ballast system 38 is significant and is preferably large enough so that structure 2 becomes substantially immovable in the water. For example, with ten ballast tanks as shown on structure 2 of FIG. 1 and with each ballast tank holding 60 gallons of water, the amount of weight added to structure 2 when ballast system 38 is completely filled with water is about 5000 lbs. (600 gallons*8.34 lbs. per gallon). The gross weight of structure 2 shown in FIG. 1 without any water in tanks 40 is only 2450 lbs. Thus, ballast system 38 when fully filled approximately triples the dry gross weight of structure 2 to help anchor structure 2 in place. Obviously, ballast system 38 when partially filled will help provide such additional weight to structure 2 needed to provide dynamic stability to structure 2 when structure 2 is being transported or floated on the surface of the body of water. If structure 2 were built with only a single lower level comprising a boat lift 8 covered by a canopy, the additional weight provided by ballast system 38 would help keep structure 2 and boat lift 8 in place even in strong winds and with boat lift 8 empty, thus solving another problem faced by conventional non-ballasted boat lifts.

Hydraulic couplings 46 between tanks 40 in each row of tanks could have individual shut off valves (not shown) therein to allow tanks 40 to be trimmed between the front and rear ends of structure 2. Suppose a relatively heavy hot tub or spa is carried on one end of deck 30. Then, when tanks 40 are filled with water, the tanks 40 beneath the end carrying such hot tub or spa could be individually shut off before all the tanks 40 in the row are completely filled with water. This would selectively provide the shut off tanks 40 with less water and more air to make such tanks 40 at least partially buoyant to better support the heavier loads on that end of structure 2. Side to side trimming of structure 2 can be done by selectively filling the ballast tanks 40 on one side of structure 2 to a greater or lesser degree than the ballast tanks 40 on the opposite side of structure 2.

At least some of the uprights 24 of structure 2 have telescopic legs 52 extending out of the bottom thereof. Such legs 52 can be selectively extended from the bottom of such uprights 24 to engage against the bottom of the body of water at the location where structure 2 is being installed. Any suitable means can be provided for locking legs 52 in their extended lengths, e.g. locking pins (not shown) selectively insertable through one of a plurality of locking holes 54 provided along the length of legs 52. See FIG. 15. Such legs 52 further secure and support structure 2 in place as shown in FIG. 6.

Preferably, the lower ends of legs 52 terminate in feet 56 for engaging against the bottom of the body of water when legs 52 are extended. It is preferred that legs 52 be extended and feet 56 placed against the bottom of the body of water when ballast system 38 is partially flooded but not completely flooded. Then, when ballast system 38 is completely flooded, the additional weight will help sink feet 56 on legs 52 into the bottom of the body of water. This will enhance the ability of legs 52 to help secure structure 2 in place.

In shallow locations where the depth of the bottom is relatively shallow and constant, wheels 36 may be removed from structure 2 as indicated by the use of dotted lines in FIG. 6. Such wheels may also be removed even if the bottom depth would be sufficient to accommodate them simply to prevent wheels 36 from being constantly submerged in water during the length of time that structure 2 is installed in the water and is in use. This will help prevent wheels 36 and, more importantly, the wheel bearings from deteriorating due to too much water exposure. The bearings will typically be protected by a seal on the wheel axle which seal is often called a Bearing Buddy, but such seals are not guaranteed for prolonged water submersion.

As shown in FIG. 6, once structure 2 is in place in the water, a landing or dock 18 may be extended from the shoreline to structure 2 to facilitate access to structure 2. Desirably, dock 18 will be at the level of the bottom of stairway 14 so that a person walking on dock 18 may simply ascend stairway 14 to access the entertainment area provided by upper level 6. Dock 18 may be installed so that it is simply adjacent to structure 2 but not connected thereto. Alternatively, structure 2 may be provided with various connectors or sockets (not shown) so that dock 18 may be physically coupled or attached to various portions of structure 2.

Structure 2 of this invention for the first time allows a user to transport a multi-level structure over a road via ground engaging wheels 36 on structure 2 and to install and remove such a structure from a body of water for seasonal use. In addition, ballast system 38 allows this to be done with a minimum of manpower and effort. Ballast system 38 when partially flooded allows the user to achieve a desired balance between buoyancy and weight so that structure 2 can be floated on the surface of the water even over long distances. Ballast system 38 when completely flooded provides sufficient weight to substantially anchor structure 2 in place in the body of water.

Moreover, ballast system 38 of this invention is particularly safe, durable and easy to use. Tanks 40 will normally be dry and buoyant when structure 2 is being placed into the water, during the spring or early summer. Thus, the user need do nothing to make structure 2 buoyant and must only back structure 2 into the water where it will float. The user can then adjust the buoyancy to partially flood tanks 40 to make structure 2 more stable to allow structure 2 to be more safely transported across the water. With structure 2 in its intended final destination, the user can then completely flood tanks 40 to sink structure 2 down into the water to its desired maximum depth, after having first extended legs 52 to engage the bottom of the body of water. If necessary, wheels 36 can be removed at any point in this process after structure 2 has been backed into the water. All of this can be done without needing any power or compressed air since tanks 40 are flooded merely by opening the manually openable and closable fill valves 44.

Once the season ends and structure 2 is to be removed from the water, wheels 36 need to be reinstalled if they have been removed and telescopic legs 52 raised. Ballast system 38 needs to be emptied of water. This is done merely by switching on the electrically operated bilge pumps 48 in each row of ballast tanks 40. Such bilge pumps 48 can be used to partially or fully empty tanks 40 of added water. Structure 2 can then be pulled out of the water and towed to a desired storage location using tow tongue 34 and ground engaging wheels 36.

When structure 2 is being pulled over public roads and the like, the height and width of structure 2 must conform to any applicable governmental limits. Accordingly, upper level 6 of structure 2 can be no higher than the prescribed maximum height permitted by law. In this respect, it may be necessary to dismount safety railing 32 provided on deck 30 as shown in FIG. 5 or alternatively to pivotally mount such railing to deck 30 to allow railing 32 to be folded flat against deck 30 or to hang down from the sides of deck 30. Obviously, any removable roof or canopy provided on upper level 6 would also have to be removed from deck 30.

The width of structure 2 can be minimized by judicious placement of tanks 40. As shown in FIGS. 1-6, vertical placement of tanks 40 along the sides of structure 2 (i.e. the long axis of tanks 40 being parallel to the sides of structure 2) is one way to do this. Another way to do this is to place such tanks largely or completely inboard of the sides of structure 2.

Figure 7:
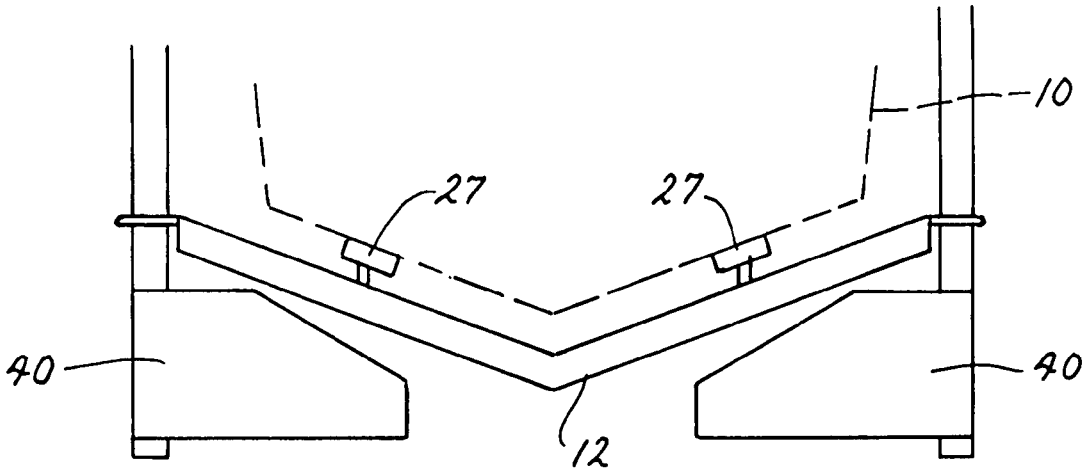
FIGS. 7 and 8 are diagrammatic rear elevational views of the structure of FIG. 1, particularly illustrating placement of the ballast tanks inboard on the structure with the ballast tanks being shaped to provide clearance to the boat lift.
Figure 8:
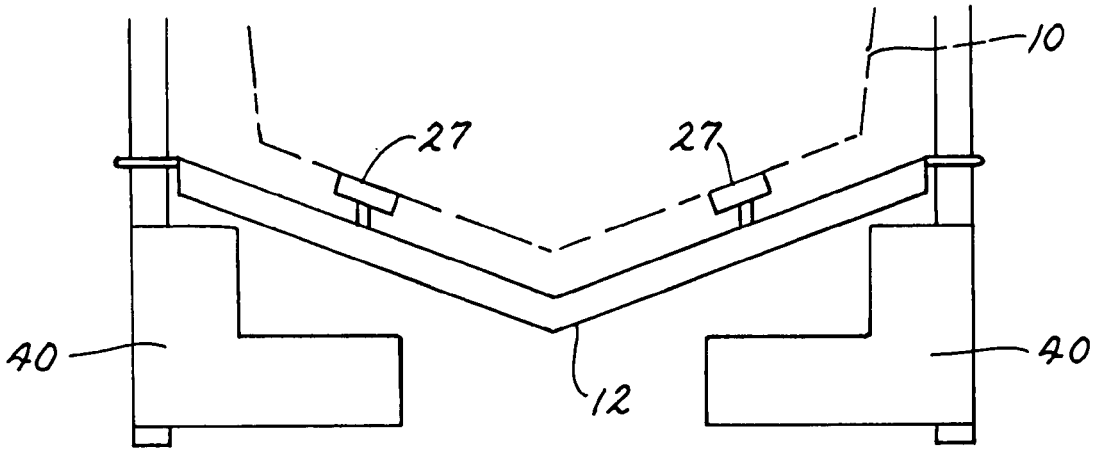

When a boat lift 8 is housed in lower level 4 of structure 2, tanks 40 when placed inboard can also be shaped to nestle beneath the V-shaped cradle 12 of boat lift 8. For example, tanks 40 can have either a slanted or L-shaped cross-section as shown in FIGS. 7 and 8. This minimizes interference with boat lift 8 while permitting inboard mounting of tanks 40. Obviously, even rectangular ballast tanks 40 extending transversely from one side of lower level 4 to the other could be used beneath boat lift 8 if so desired. However, this would entail an increase in the vertical height of structure 2 to provide sufficient clearance between the downwardly pointing midpoint of the V-shaped cradle 12 and such a tank 40.

Figure 9:
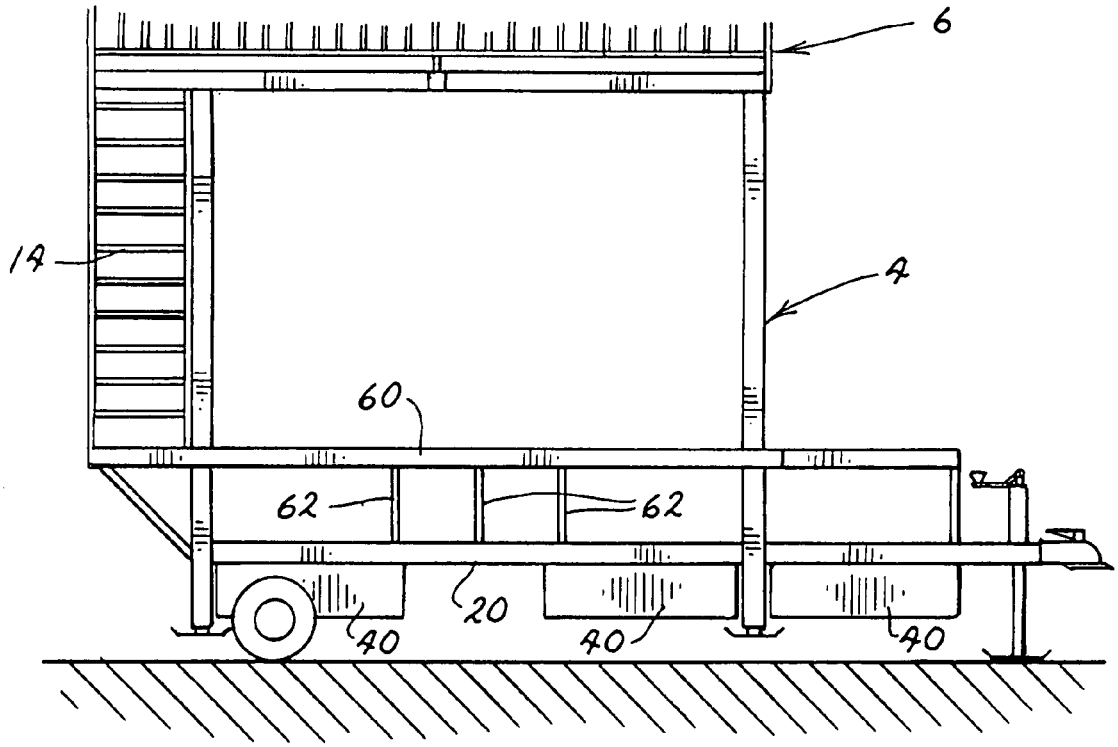
FIG. 9 is a side elevational view of another structure according to this invention, particularly illustrating a multi-level structure providing a deck on the lower level and an entertainment area on the upper level, the structure being shown disposed on the ground for ground transport.

Another embodiment of structure 2 is one where lower level 4 is not used to house a boat lift, but is instead used to provide a second or additional entertainment area. This is shown in FIG. 9. A solid weight bearing floor or deck 60 is installed on lower level 4 of structure 2 in place of boat lift 8. Such a lower deck 60 can be placed at the level of the bottom of stairway 14 and can itself be extended out from one end of structure 2 to form the landing for stairway 14. Lower deck 60 on lower level 4 can be braced or held above base 20 by a plurality of vertical spacers 62 or the like extending upwardly from base 20 to the underside of lower deck 60.

Figure 10:
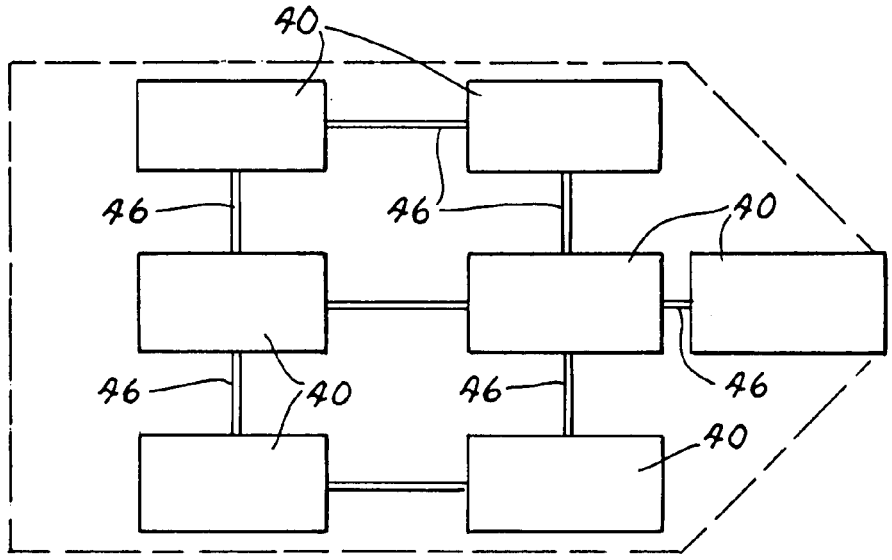
FIG. 10 is a diagrammatic bottom plan view of the structure of FIG. 9, particularly illustrating a single array of ballast tanks.

In this embodiment of structure 2 as shown in FIGS. 9 and 10, a plurality of ballast tanks 40 can be arranged in a single array beneath base 20 rather than being arranged in separate arrays along the sides of structure 2. All of tanks 40 in this single array can be interconnected together by hydraulic couplings 46. A bilge pump and fill valve are installed in one or more of the tanks 40 in the array. The single array of ballast tanks 40 is filled and operated in much the same way as when tanks 40 were disposed in multiple arrays, except that only a single pump and fill valve are used. Preferably, each ballast tank 40 still has its own individual air vent (not shown in FIGS. 9 and 10).

Figure 11:
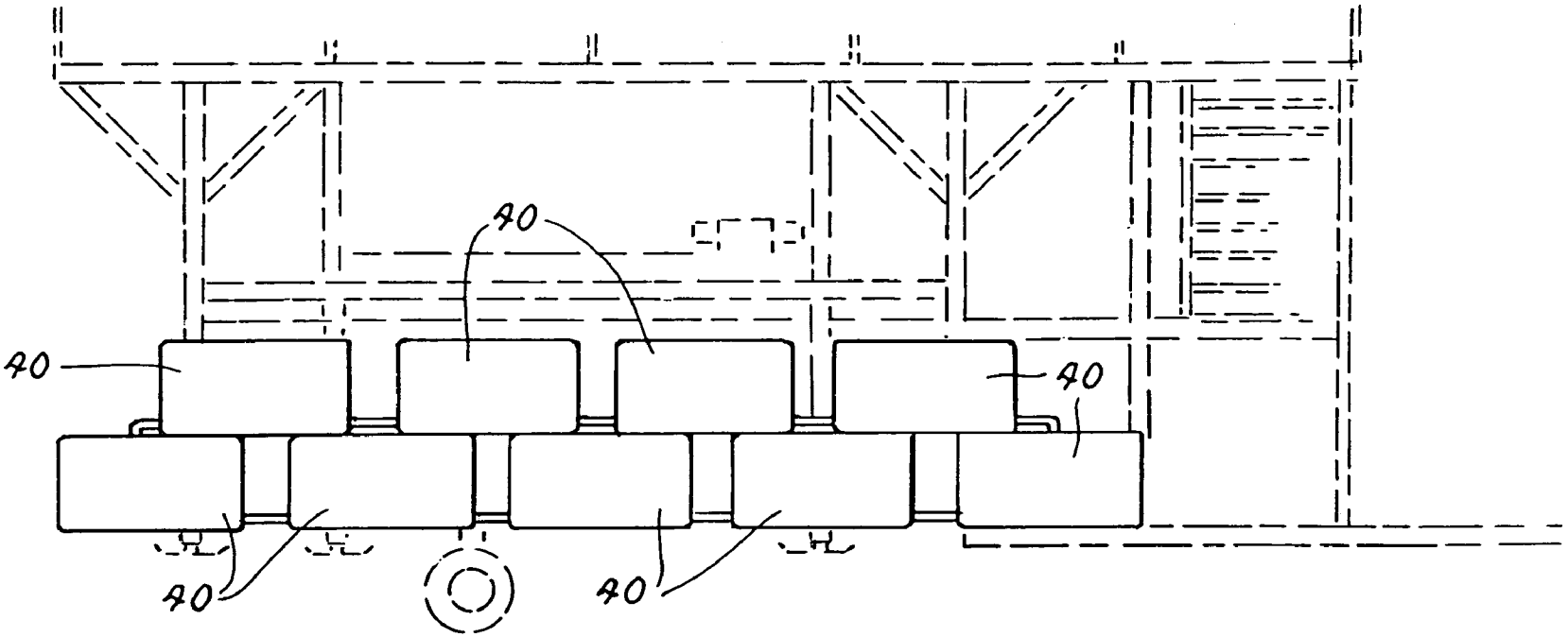
FIG. 11 is a side elevational view of the structure of FIG. 1, particularly illustrating an alternative in which the ballast tanks are carried on each side of the structure in an array comprising two horizontal rows of tanks that are vertically stacked on top of each other.

In another arrangement of ballast tanks as shown in FIG. 11, each row of ballast tanks in the embodiment of FIGS. 1-6 can be replaced by a multi-level row of ballast tanks to increase the amount of weight that can be added to structure 2 when tanks 40 are completely filled with water. In such a multi-level row, tanks 40 in upper rows can be offset relative to tanks 40 in the lower rows like bricks in a brick wall. Again, all tanks 40 in such a multi-level row will be interconnected together and a single bilge pump and fill valve can be placed into one of the tanks 40 in the lowest level of the plural stacked rows.

Figure 12:
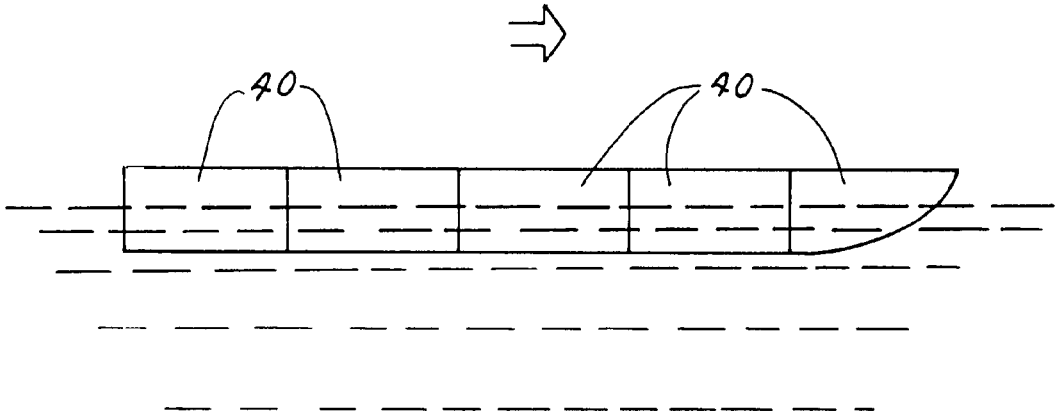
FIGS. 12 and 13 are diagrammatic side elevational views of an array of ballast tanks used with the structure of FIG. 1, particularly illustrating two alternatives in which the tanks within the array are shaped to have an overall front to back hull or torpedo like configuration, respectively, to aid in towing the structure through the water.
Figure 13:
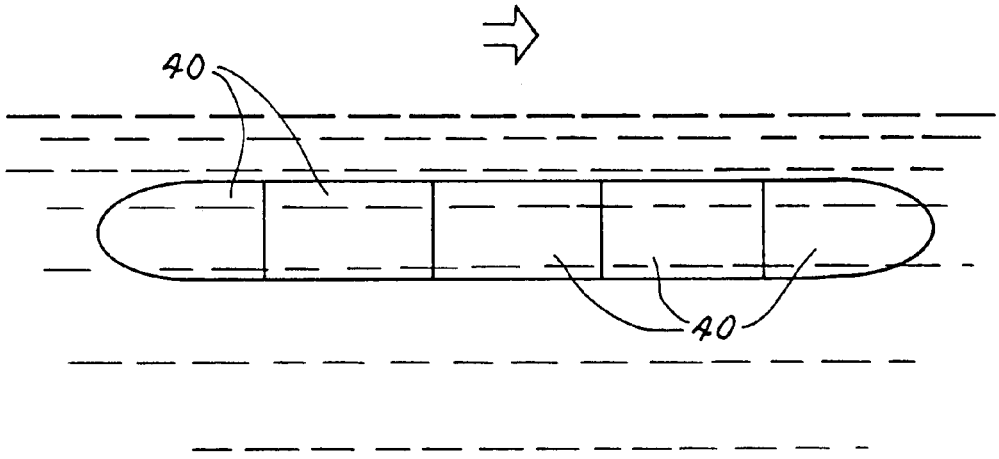

Referring now to FIGS. 12 and 13, tanks 40 in each row of tanks can be shaped relative to each other so that each row of tanks has an overall shape or configuration that more easily passes through the water during water transport of structure 2. FIG. 12 shows the five tanks 40 in each row thereof shaped much like a keel or hull (with the gaps between tanks 40 and couplings 46 being omitted for the sake of clarity). FIG. 13 shows the five tanks 40 in each row having an overall torpedo or bullet shape. Either of these configurations allows for smoother towing with less drag than the merely rectangular shape of the row of tanks as shown in FIGS. 1-6. Moreover, structure 2 will be very stable during water transport if structure 2 is towed with tanks 40 partially flooded and the torpedo or bullet shape of FIG. 13 largely submerged.

Figure 14:
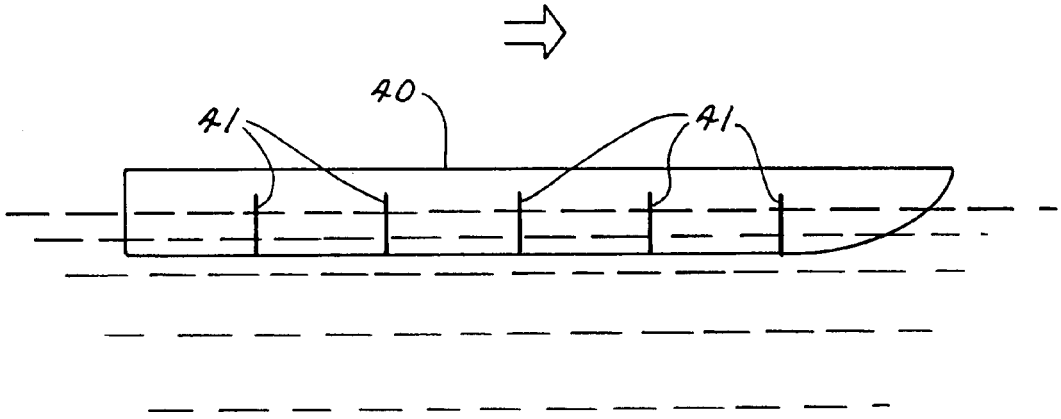
FIG. 14 is a diagrammatic side elevational view of a single large ballast tank used with the structure of FIG. 1, particularly illustrating a plurality of partial height baffles within the ballast tank.

FIG. 14 shows a ballast tank that can be used along each side of structure 2 or underlying structure 2 comprising a single long ballast tank 40 having an overall hydrodynamic shape like that shown in FIG. 12. Such a single large tank 40 would perhaps be more difficult and expensive to obtain, but actually presents less drag in the water than an array of separate, smaller, interconnected tanks even when such an array is hydrodynamically shaped as in FIGS. 12 and 13. Such a single large tank 40 would preferably have a plurality of internal, partial height, vertical baffles 41 that would have lower holes therein (not shown) to let the water slowly flow through the baffles 41 when water is being added or pumped from tank 40 so that tank 40 fills and drains evenly. However, during water transport of structure 2, baffles 41 would prevent any ballast water within tank 40 from sloshing to the rear of tank 40 as structure 2 crests a wave, thereby preventing instability and possible capsizing of structure 2.

Figure 15:
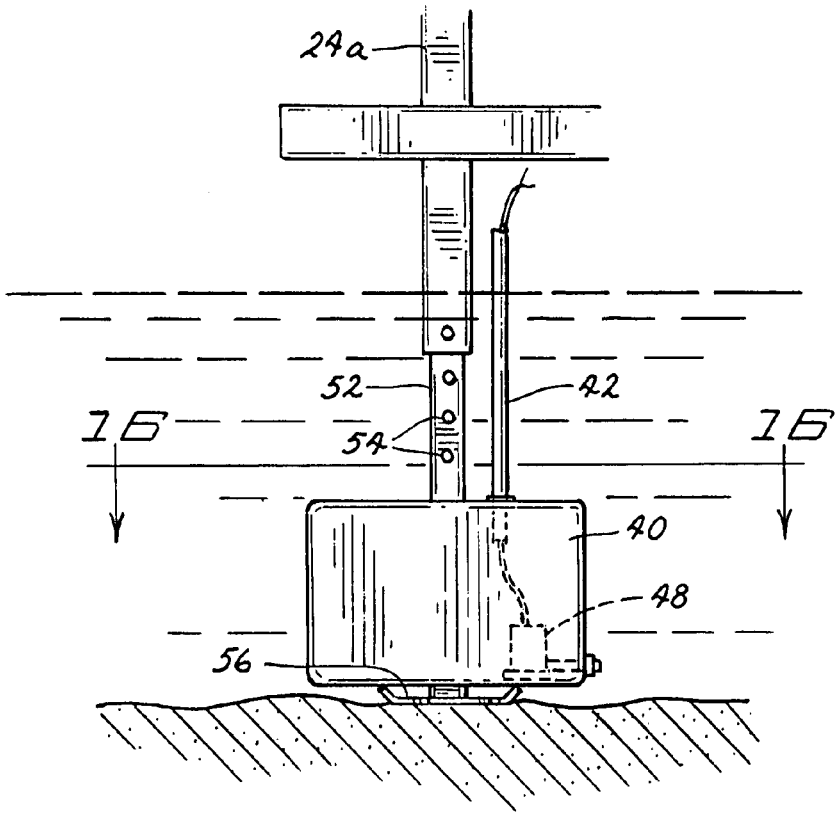
FIG. 15 is a partial side elevational view of one of the telescopic legs of the structure shown in FIG. 1, illustrating an alternative in which the ballast tanks are carried on the telescopic legs of the structure rather than on the sides of the structure.
Figure 16:
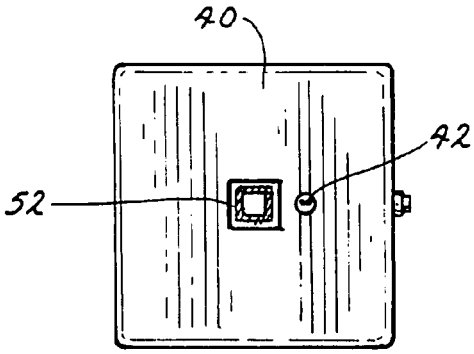
FIG. 16 is a cross-sectional view of the ballast tank alternative shown in FIG. 15 taken along lines 16-16 in FIG. 15.

FIGS. 15 and 16 illustrate an alternative way to carry tanks 40 on structure 2. Each ballast tank can be carried on one of the extendible legs 52 either in a fixed or slidable fashion. As tanks 40 are filled with water, the weight of tanks 40 will cause legs 52 to extend downwardly out of structure 2 until feet 56 on the lower ends of legs 52 engage against the bottom of the body of water. Alternatively, if tanks 40 are slidably carried on legs 52, legs 52 could be extended downwardly before tanks 40 are filled and then tanks 40 will slide down legs 52 as they are being filled. In any event, legs 52 can still be locked in place on structure 2 after they have engaged the bottom.

One advantage of placing tanks 40 on legs 52 of structure 2 is the fact that the weight or ballast provided by tanks 40 is located as low as possible, even lower than base 20 of lower level 4. However, one disadvantage of placing tanks 40 on legs 52 of structure 2 rather than somewhere else is the need to have individual pumps and fill valves for each tank along with snorkel tubes 42 that have a maximum length that will keep the upper ends of tubes 42 above the water line. One approach for such a snorkel tube would be to have a tube that would be a flexible, coiled tube that could unroll as tank 40 sinks to the bottom of the body of water.

Various other modifications will be apparent to those skilled in the art. For example, fill valve 44 could be placed in tank 40 that is at the rear end of structure 2 furthest from tongue 34. Then, when structure 2 is first removed from the body of water at the end of the season, structure 2 can be tipped to the rear about wheels 36 by elevating tongue 34. Fill valve 44 will then be the lowermost portion of the array of ballast tanks 40 and if opened can be used to drain any water that remains the ballast tanks 40 prior to storage of structure 2. Moreover, structure 2 could simply comprise a single level, weight bearing deck forming a section of a dock.

The use of one or more electrically operated bilge pumps 48 is preferred for evacuating ballast tanks 40 since such pumps 48 can pump the water out at synchronized, controllable, relatively slow rates. External manually operated pumps could also be used. However, a compressed air system could be substituted for pumps 48 to blow the water out of ballast tanks 40.

Ballast system 38 represents one type of buoyancy system that provides structure 2 with buoyant and non-buoyant states to float structure 2 on the body of water or to sink structure 2 in the body of water. Ballast system 38 does so by evacuating water therefrom or by adding water thereto, respectively.

Figure 17:
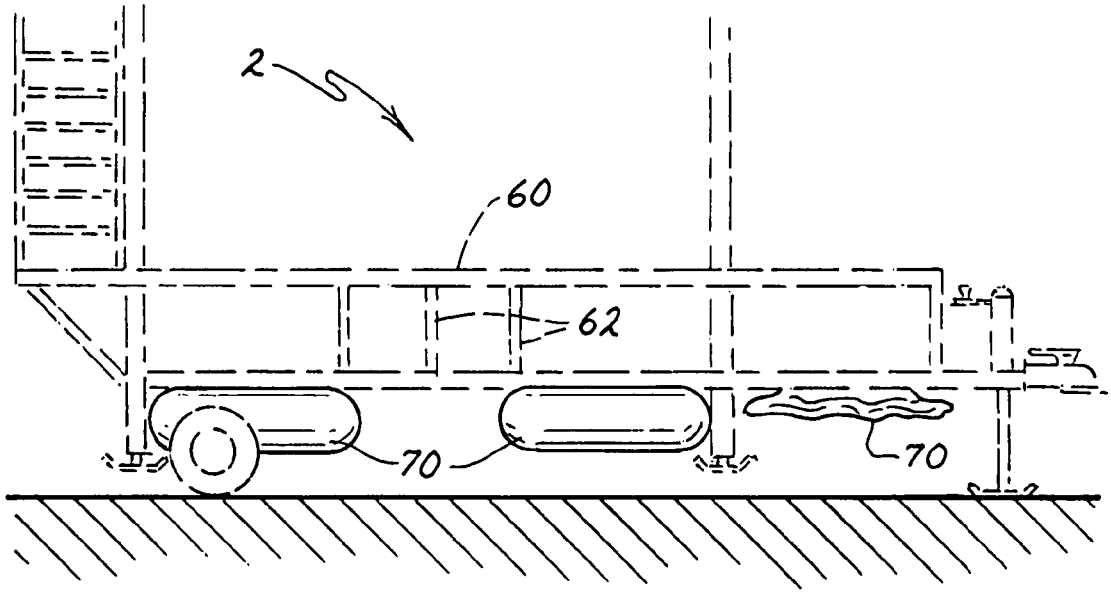
FIG. 17 is a side elevational view of another structure according to this invention, particularly illustrating an alternative buoyancy system comprising an inflatable bag or bladder system for selectively providing buoyancy to a multi-level structure, the structure being shown disposed on the ground for ground transport.

FIG. 17 illustrates an alternative buoyancy system which may be used in place of ballast system 38. In this alternative system, ballast tanks 40 are replaced with a plurality of flexible, inflatable air bags or bladders 70. FIG. 17 shows three such bladders 70 on structure 2 with two bladders 70 being shown fully inflated and expanded and one bladder 70 being shown fully uninflated and collapsed. The number of bladders 70 and their placement on structure 2 could obviously vary just as the number and placement of tanks 40 can vary.

Bladders 70 would have suitable air valves (not shown), similar to those used on pneumatic tires, to allow compressed air to enter and inflate bladders 70 and to allow such compressed air to be bled from and permit bladders 70 to collapse. Such bladders 70 would be inflated from a source of compressed air provided on structure 2 or externally of structure 2.

A buoyancy system comprised of inflatable bladders 70 is not preferred over ballast system 38. Bladders 70 are much more prone to being punctured and uninflated by being snagged or hooked on something than are ballast tanks 40, at least when such tanks 40 are made from a rigid plastic or metallic material as would usually be the case. One could attempt to protect bladders 70 by placing them well inside structure 2 beneath base 20, but even so it would still be somewhat likely that one or more bladders 70 would be punctured at some time, either when structure 2 was in the water or was out of the water. This would mean the repair or replacement of the damaged bladder(s) 70, which is obviously inconvenient and expensive.

While bladders 70 could be pneumatically linked together in groups or arrays to allow the groups or arrays to be simultaneously inflated and collapsed, the danger of bladder puncture would militate against this. Instead, it would be safest to use separate bladders 70 that are individually inflated and collapsed so that the puncture of one bladder 70 would not affect the inflated state of the remaining bladders 70. However, it would take more time and be more work to have to inflate and collapse each bladder 70 individually.

Yet another reason for preferring the use of ballast system 38 is that ballast system 38 adds significant weight to a light structure while inflatable bladders 70 have to provide buoyancy to a heavier structure. If one wants structure 2 to weigh 7,500 pounds when in the water, then one can build a 2,500 pound structure 2 equipped with ballast tanks 40. The ballast in the form of the water added to ballast tanks 40 makes up the difference. Thus, one only needs 2,500 pounds of materials to construct structure 2 and only this amount has to be towed by a tow vehicle.

The situation is the reverse if one uses a buoyancy system made of inflatable bladders 70. One has to start with a structure weighing 7,500 pounds meaning more material must be used in the construction of structure 2 and one now has to tow a 7,500 pound structure. Bladders 70 then must be sized to provide more than 7,500 pounds of buoyancy to allow structure 2 to float. Thus, ballast system 38 is far more economical and efficient when used on structure 2 than an inflatable system of flexible bladders 70.

Figure 19:
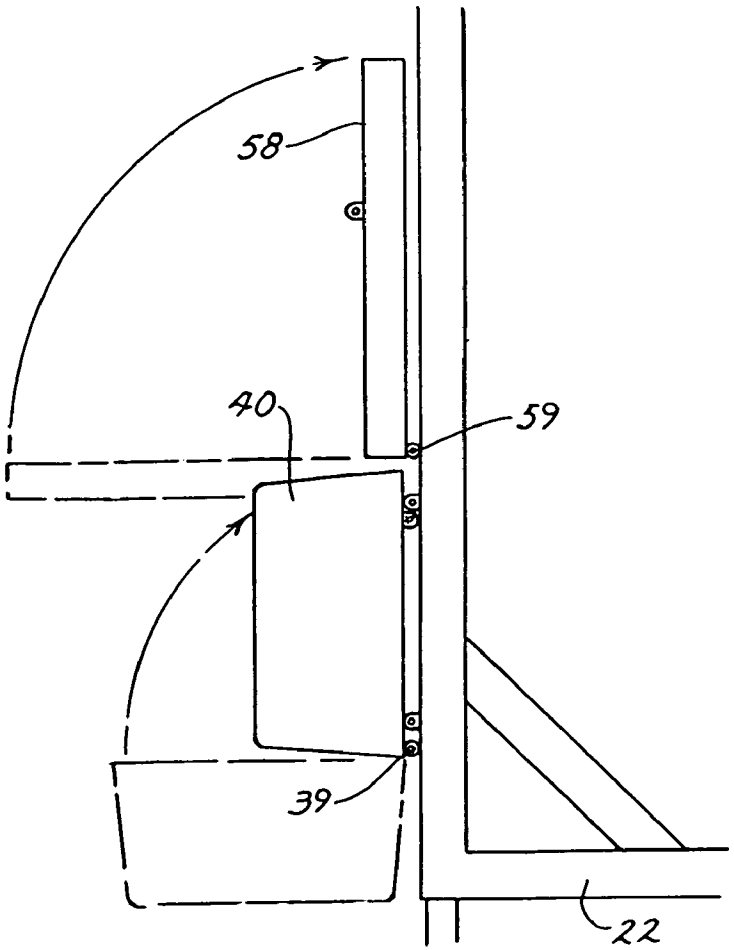
FIG. 19 is a partial rear elevational view similar to FIG. 18, particularly illustrating the side catwalk and the ballast tanks pivoted into generally vertical transport or storage positions to minimize the width of the structure.
Figure 18:
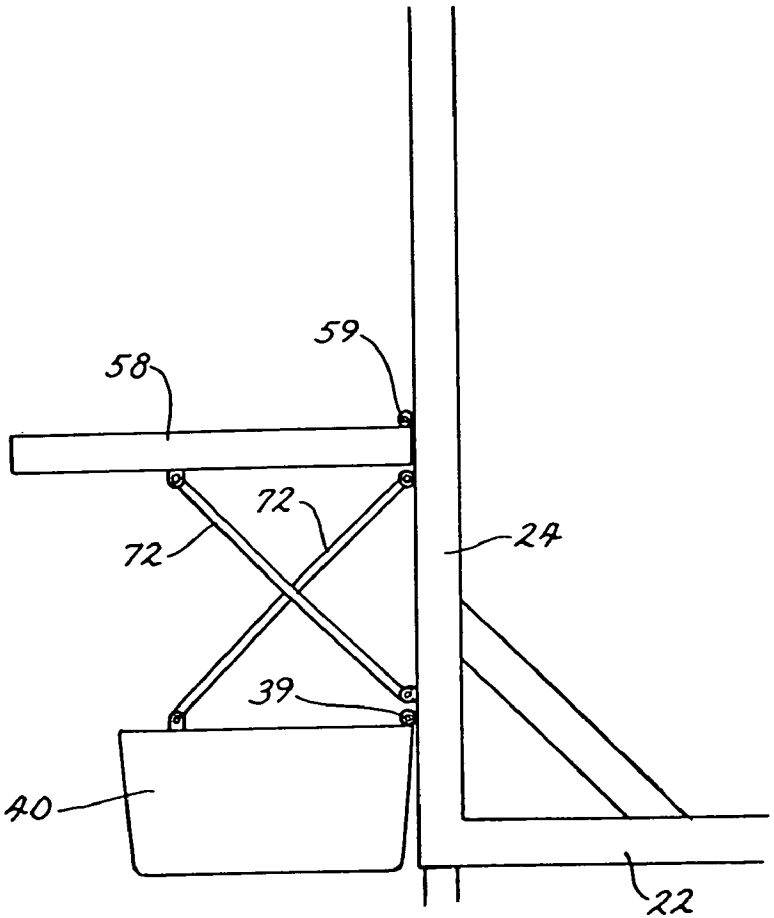
FIG. 18 is a partial rear elevational view of the structure of FIG. 1, particularly illustrating an alternative in which the ballast tanks are oriented generally horizontally and are placed beneath a side catwalk with the side catwalk and ballast tanks being shown in their generally horizontal operational positions.

FIGS. 18 and 19 show an alternative form of a structure 2 according to this invention. In this alternative embodiment, a horizontal catwalk 58 projects laterally from each side of structure 2 to allow a user to walk along each side of structure 2. Catwalk 58 is hinged to the side of structure 2 by a pivot shaft 59. Normally, catwalk 58 is disposed in a generally horizontal operational position shown in FIG. 18.

In this alternative structure 2, the rectangular ballast tanks 40 are arranged generally horizontally, i.e. the long axis of tank 40 is generally horizontal in FIG. 18 rather than vertical as in FIG. 1. Tanks 40 in each row of tanks 40 are carried on the exterior of structure 2 beneath each catwalk 58. Preferably, however, tanks 40 along their long axis are no wider than, and preferably a bit shorter than, the width of each catwalk 58. This allows boats or the like to dock against catwalk 58 without engaging and damaging tanks 40. Tanks 40 are hinged to each side of structure 2 by a pivot shaft 39 in a manner similar to catwalk 58.

Referring to FIG. 18, each catwalk 58 and the tanks 40 underneath such catwalk 58 are normally disposed in a generally horizontal operational position extending outwardly from one side of structure 2. Catwalks 58 and tanks 40 are disposed in this position when structure 2 is installed in a body of water and is in use. Pivotal crossbraces 72 extend between the bottom of catwalk 58 and upright 24 and between the top of tank 40 and upright 24 to help hold catwalk 58 and tank 40 in their generally horizontal operational positions. However, after structure 2 has been removed from the body of water, crossbraces 72 are released from upright 24 to pivot each catwalk 58 and the underlying tanks 40 into a generally vertical, upright position lying flat against the side of structure 2 as shown in FIG. 19. Catwalks 58 and tanks 40 can be strapped or latched in their FIG. 19 positions to reduce the width of structure 2 for transport and/or storage.

Figure 20:
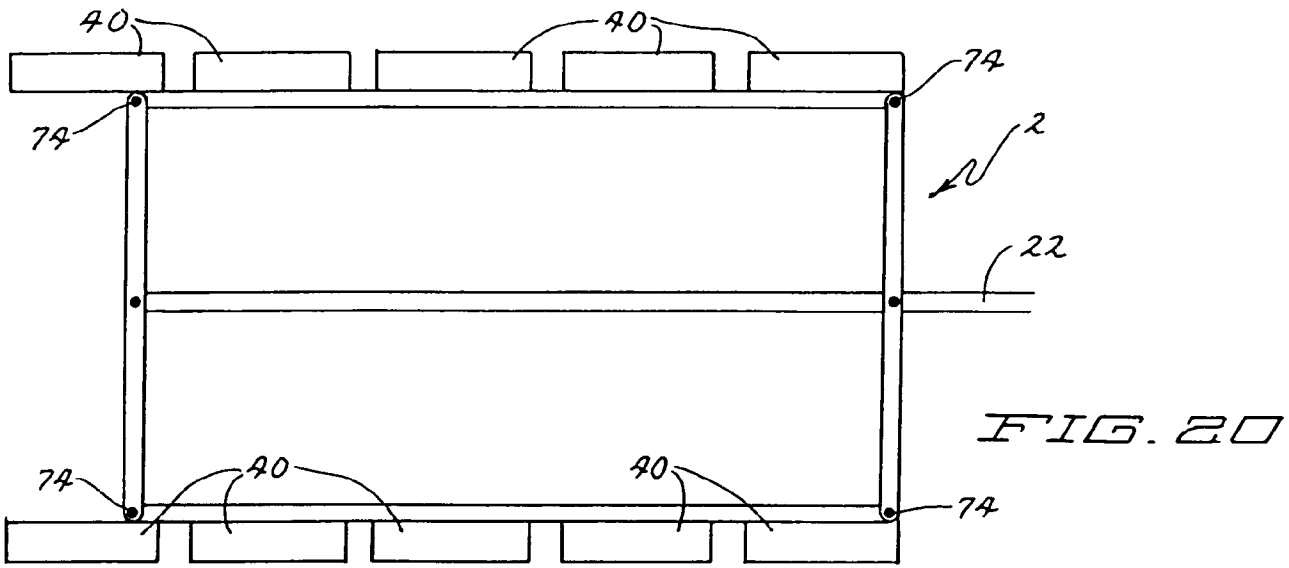
FIG. 20 is a diagrammatic top plan view of an alternative structure according to this invention, particularly illustrating the structure disposed in an expanded width operational position.

Another way to reduce the width of structure 2 for transport and/or storage is to make structure 2 expandable and collapsible in width. As shown in FIG. 20, each side of structure 2, namely the left side, right side, the front end, and the rear end, can be pivotally connected to one another at the corners of structure 2 and to a longitudinal beam 22 carrying the tow hitch. These pivots are shown diagrammatically as 74 in FIG. 20. This allows structure 2 to be expanded into its usual, square or rectangular operational configuration having perpendicular corners. In this configuration, structure 2 has a maximum width for use in a body of water. Some type of latch or lock (not shown) would be provided to lock the sides of structure 2 together in this configuration, i.e. to prevent the sides from pivoting relative to one another during use of structure 2 in the body of water.

However, after structure 2 is removed from the body of water and prior to its being towed or stored, the sides of structure 2 can be unlocked or unlatched to allow structure 2 to be collapsed in width. This is done by pulling forwardly on one side of the front and rear ends of structure 2 and by pushing rearwardly on the opposite side of the front and rear ends of structure 2. The front and rear ends of structure 2 will pivot about beam 22 relative to the left and right sides of structure 2 to change the shape of structure 2. The corners of structure 2 are no longer perpendicular but are now angled. Structure 2 no longer has a square or rectangular configuration but is instead a parallelogram with angled front and rear ends as shown in FIG. 21.

Figure 21:
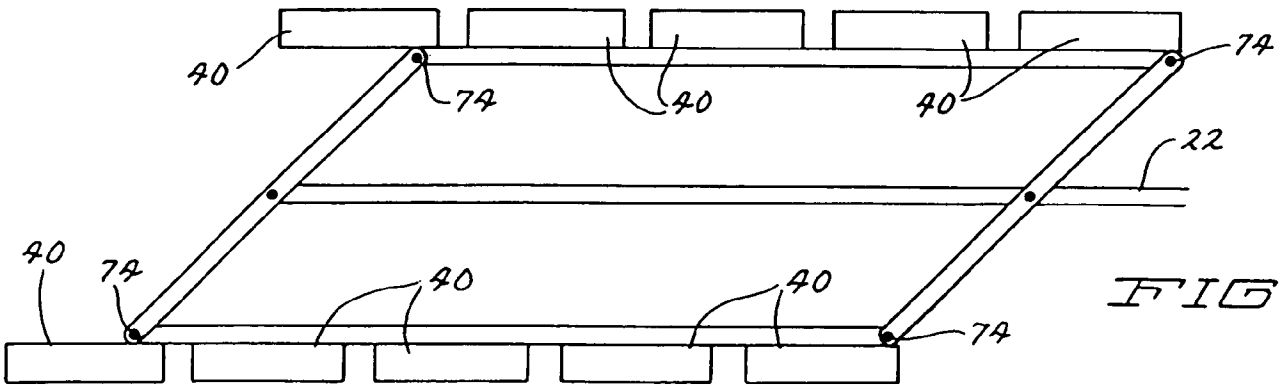
FIG. 21 is a diagrammatic top plan view similar to FIG. 20, particularly illustrating the structure disposed in a collapsed width transport or storage position.

When structure 2 is then locked in the configuration of FIG. 21 and wheels 36 are attached thereto, structure 2 can then be towed along the axis of beam 22 by a hitch secured to beam 22. Structure 2 can be towed more easily as the width thereof is significantly reduced from its usual operational width. This allows structure 2 to more easily meet any applicable width restrictions for towed objects that might be imposed by various governmental entities.

FIGS. 22-29 disclose an alternative structure according to this invention. The structure is separable into a plurality of sections to reduce the towed width of the structure. In other words, each section comprising the structure will have a towed width less than the usual width of the structure when the structure is in operation in a body of water. Again, this eases the task of complying with any width restrictions that might be applicable to the towing of objects on a roadway or highway.

Referring now to FIGS. 22-25, the structure when assembled comprises an enclosed boathouse 76. Boathouse 76 is a single story structure having a lower level 4 that includes a boat lift 8.

Boathouse 76 is built generally similarly to structure 2 shown in FIGS. 1-8. In other words, boathouse 76 comprises a base 20 formed of longitudinal and transverse beams 22 that are welded and bolted together. A plurality of uprights 24 extend upwardly from base 20. Uprights 24 are joined together at the top by side headers 78 extending longitudinally along the left and right sides of boathouse 76 and by front and rear headers 80 extending transversely along the front and rear ends of boathouse 76.

Figure 23:
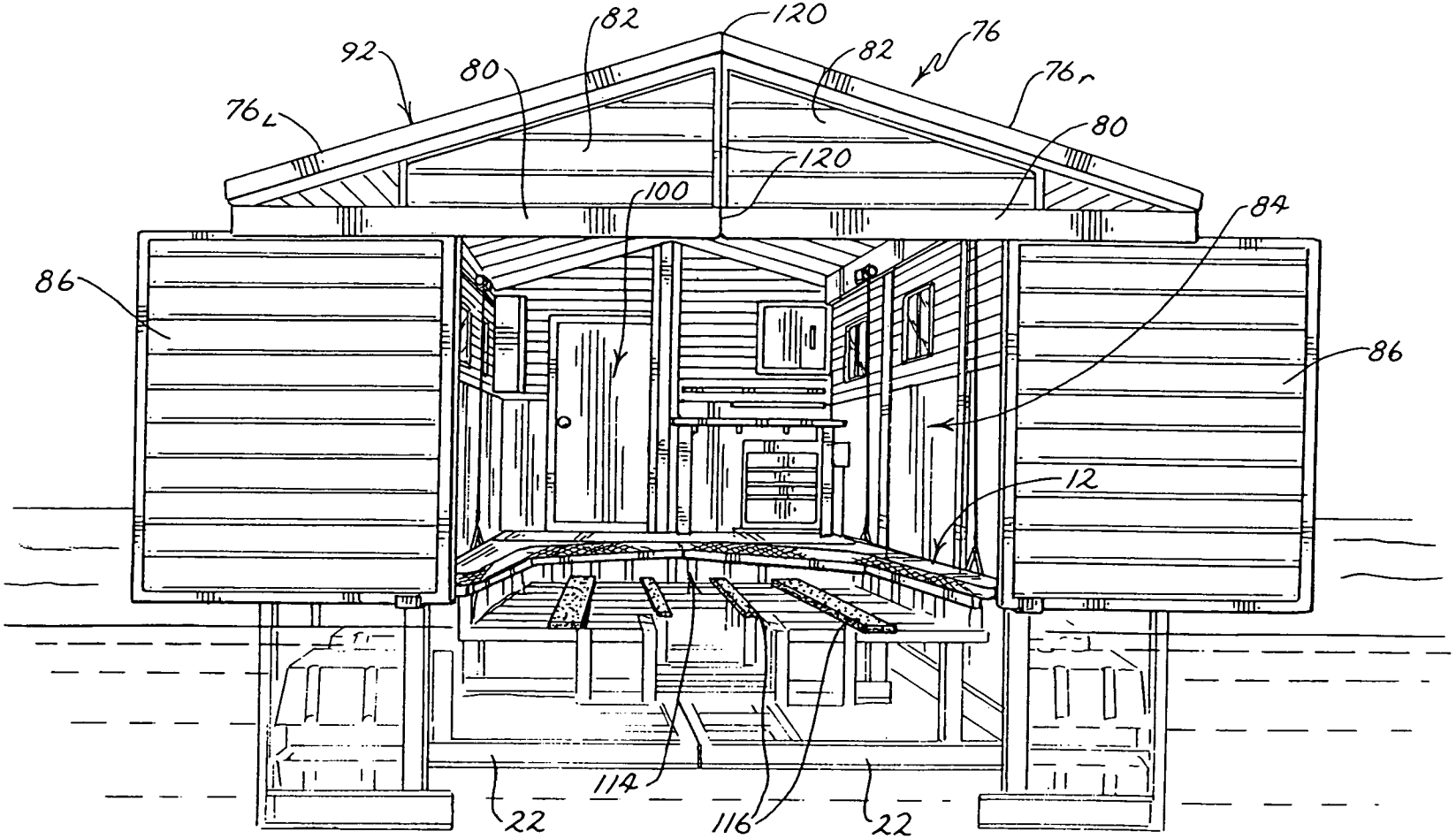
FIG. 23 is a rear elevational view of the structure of FIG. 22, particularly illustrating the doors of the boathouse open to illustrate the interior of the boathouse including the boat lifting cradle.
Figure 25:
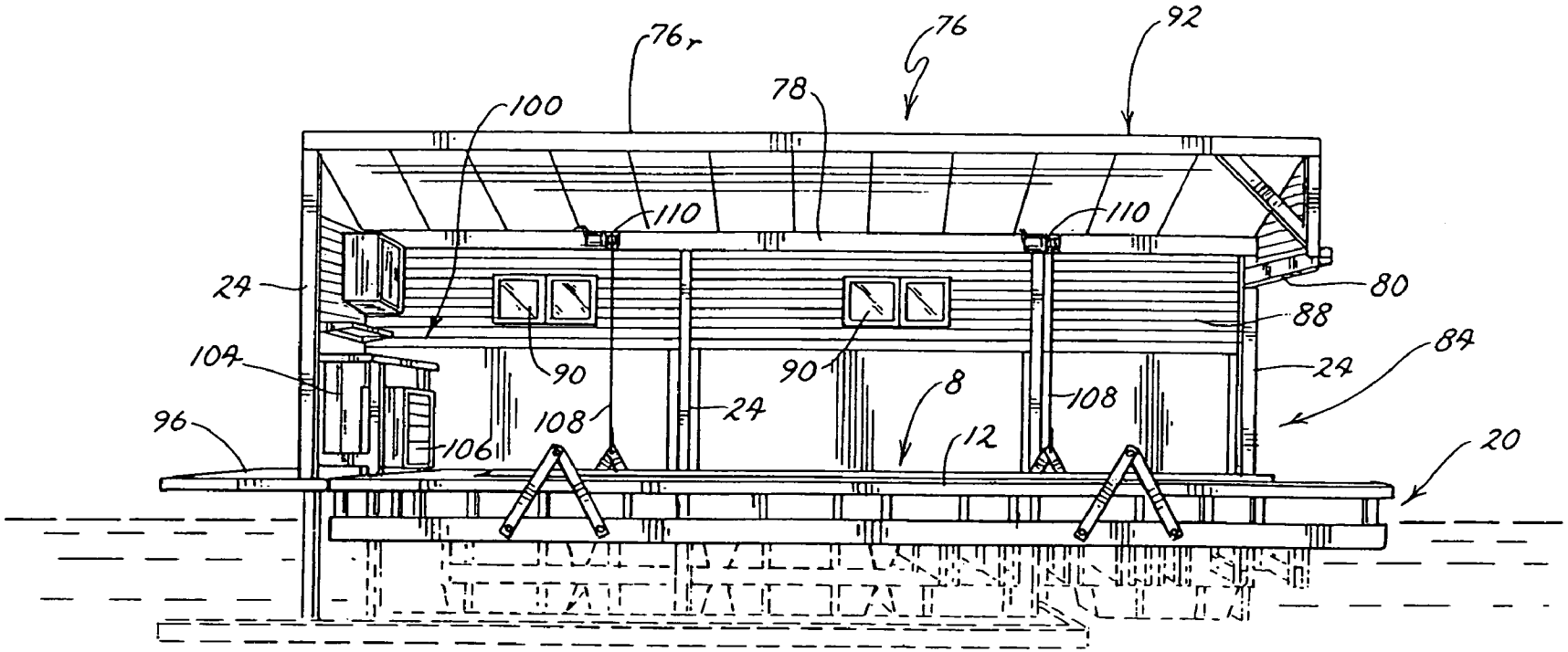
FIG. 25 is a side elevational view of the structure of FIG. 22, particularly illustrating one of the longitudinal halves that the boathouse may be split into for transport or storage with the boat lifting cradle being shown in its usual horizontal operational position.
Figure 26:
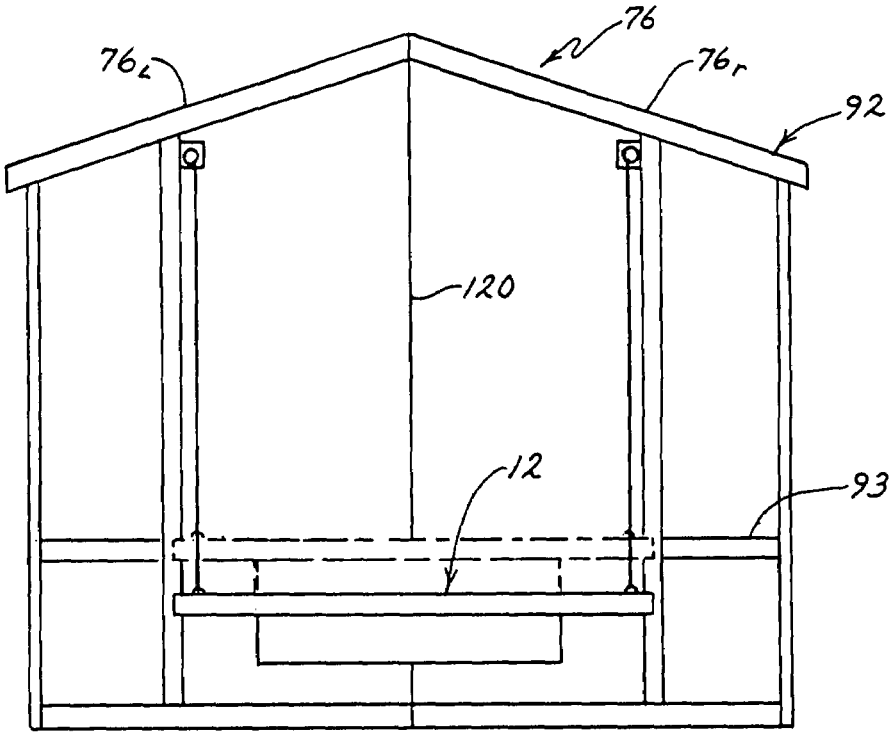
FIG. 26 is a diagrammatic rear elevational view of the boathouse of FIG. 22, particularly illustrating the two longitudinal boathouse halves assembled together for operation as a unitary boathouse.

Uprights 24 are covered along the front end and the left and right sides of boathouse 76 by a solid exterior covering or sheathing 82 to form a substantially enclosed boathouse 76. Such a sheathing 82 is also used on the rear end of boathouse 76 above the transverse rear header 80 with sheathing 82 not being used on the rear end of boathouse 76 below the transverse rear header 80. This provides an entrance 84 below the transverse rear header 80 to allow a boat to be driven into or out of boathouse 76 when boathouse 76 is in use in a body of water. Entrance 84 is shown in FIGS. 23 and 25.

Entrance 84 can be opened or closed by a pair of slidable garage type doors 86 carried on the rear end of boathouse 76. In FIG. 23, doors 86 are shown open as they would be when a boat is being driven into boathouse 76. Doors 86 can be slid together to close off entrance 74 when desired so that all four sides of boathouse 76 would be substantially enclosed. Doors 86 can be closed either manually or by some type of motorized garage door opener/closer.

Sheathing 82 preferably comprises a solid, substantially rigid material, such as vinyl siding or the like. This sheathing 82 would also preferably be used to form or cover the framework of doors 86. However, sheathing 82 could comprise materials other than vinyl siding, including a flexible material such as canvas or the like.

If desired, the upper portions of uprights 24 along the front end and the left and right sides of boathouse 76 carry a decorative interior wood trim 88, such as wood paneling, to provide a more aesthetic appearance to the interior of boathouse 76. Wood trim 88 is visible when a boat is located within boathouse 76 and is in a raised storage position on boat lift 8. If desired, windows 90 can be placed in the left side and right sides of boathouse 76.

A peaked roof 92 is used on boathouse 76 to close off the top of boathouse 76 and protect the boat stored within boathouse 76. Roof 92 is preferably formed as a solid, substantially rigid roof made of any appropriate roofing materials, such as a vinyl or metallic material or asphalt or fiberglass shingles applied over a wooden sub-base. Alternatively, roof 92 could comprise a flexible fabric canopy supported on appropriate framework.

Roof 92 is preferably extended beyond the left and right sides of boathouse 76 to substantially cover a catwalk 93 provided on both the left and right sides of boathouse 76. The outer periphery of each catwalk 93 includes a plurality of uprights 94 that extend up and support the side edges of roof 92. The use of catwalk 93 and uprights 94 in addition to uprights 24 and side headers 78 form a very rigid and strong box-like structure when united or joined to roof 92. Catwalk 93 runs the full length of boathouse 76 and projects slightly beyond the front end of boathouse 76 to mate with a front landing 96.

When boathouse 76 is in place in the body of water, front landing 96 will abut with or be adjacent the shoreline to allow a user to approach boathouse 76 and walk onto front landing 96 to gain access to boathouse 76. The user can enter boathouse 76 through a front door 98 that is provided in the front end of boathouse 76. Alternatively, the user can walk along either side of boathouse 76 on catwalks 93. When the user reaches the rear of catwalks 93, the user can grip boathouse doors 86 to open or close doors 86 manually if desired. Front landing 96 and catwalks 93 also form recreational platforms from which the user can fish or possibly jump or dive into the body of water depending upon the depth of the water.

Figure 24:
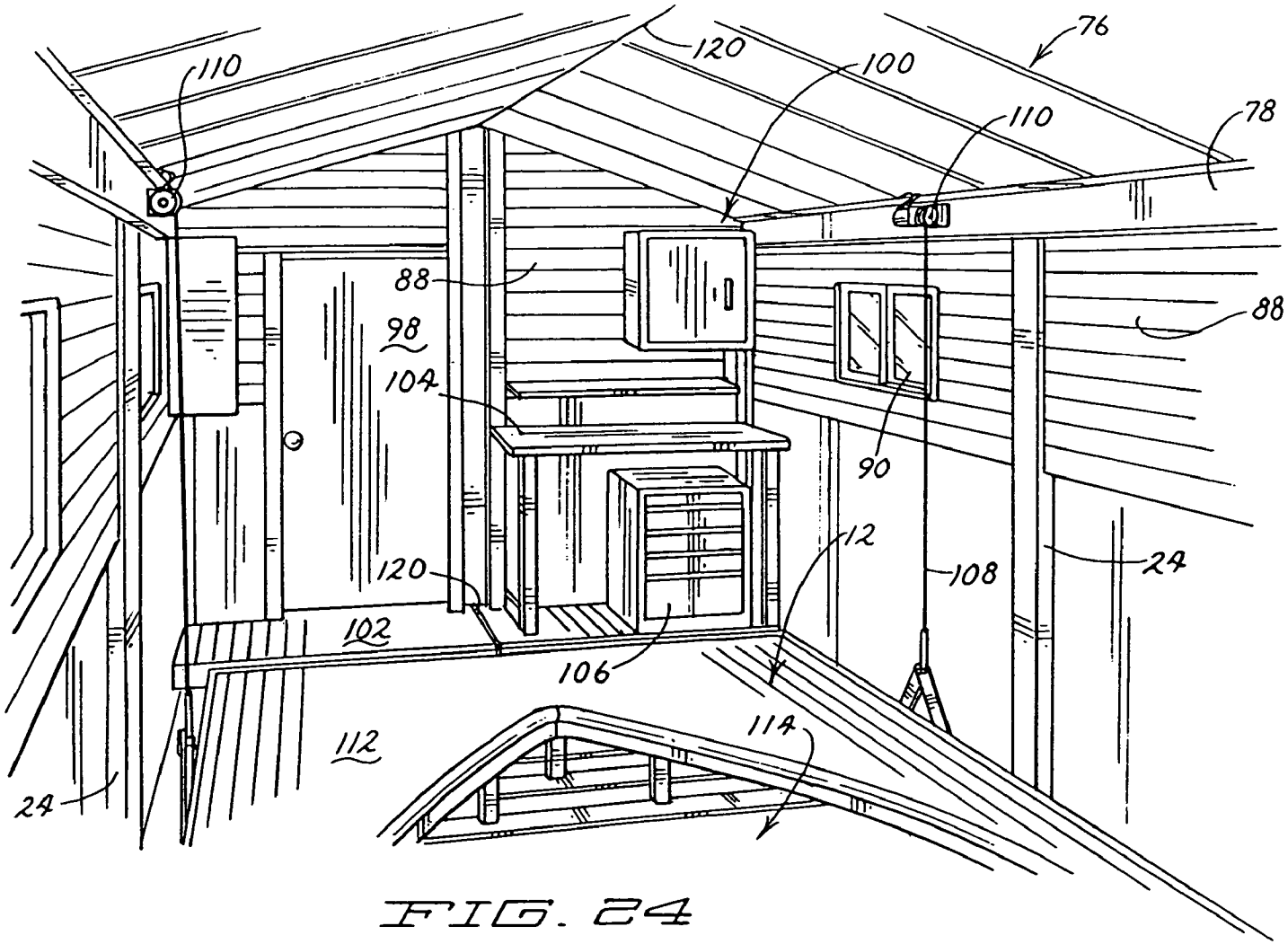
FIG. 24 is an enlarged perspective view of the interior of the front end of the structure of FIG. 22, particularly illustrating a work area at the front end of the boathouse as well as the front end of the boat lifting cradle.

Referring now to FIGS. 23-25, the interior of the front end of boathouse 76 includes a work area 100 that has a small floor 102 immediately inside front door 98 supporting a workbench 104 and a tool chest 106. Boat lift 8 comprises a cradle 12 for lifting and lowering a boat (not shown) into and out of contact with the body of water. This lifting and lowering is done by a plurality of lift cables 108 connected to the left and right sides of cradle 12. Lift cables 108 extend upwardly to winches 110 mounted on side headers 78. However, cradle 12 used in boathouse 76 is somewhat different than cradle 12 shown in FIGS. 1-8.

In cradle 12 used in boathouse 76, cradle 12 has a deck 112 surrounding a hull-shaped cavity 114 generally conforming to the shape of the hull of the boat that will be received in cradle 12. As shown in FIG. 23, cavity 114 is open at the rear with a plurality of protective bumpers or pads 116 extending longitudinally over the bottom of cavity 114. A boat can be driven or floated into cavity 114 until the bottom of the hull is received on pads 116 and the hull is fully received within cavity 114. Of course, the entry of the boat into cradle 12, and more particularly into cavity 114 provided on cradle 12, is done when cradle 12 has been lowered down into the body of water using cables 108 and winches 110.

After a boat is properly loaded into cradle 12 as described above, cradle 12 can be lifted into a position in which the boat is lifted out of contact with the body of water. In this position, as shown in FIG. 24, deck 112 of cradle 12 vertically mates with floor 102 of work area 100 to form a continuation or extension thereof. Thus, with cradle 12 in its raised position, the user can walk from work area 100 along either side of the boat or can stand in front of the boat since cavity 114 in cradle 12 stops well short of the front of cradle 12. See FIG. 24. The front portion of deck 112 of cradle 12 extends in front of workbench 104 to allow the user to stand in front of workbench 104 and use workbench 104 and tool chest 106.

Boathouse 76 shown in FIGS. 22-29 is provided with a selectively operable buoyancy system like that of either FIGS. 1-16 or FIG. 17, i.e. either a ballast system 38 using ballast tanks 40 or a system using inflatable bladders 70. A ballast system 38 is shown in FIGS. 22-29 with tanks 40 being arranged in base 20 of boathouse 76 generally beneath each catwalk 93 and beneath front landing 96 of boathouse 76. Tanks 40 will have various vents, fill valves, and one or more pumps for admitting water to tanks 40 and for pumping water out of tanks 40 as described earlier in connection with FIGS. 1-16. The placement of tanks 40 beneath catwalks 93 and front landing 96 is advantageous in protecting tanks 40 from damage from boats or other objects that may be moored to or placed next to the front, left side and right sides of boathouse 76.

Figure 22:
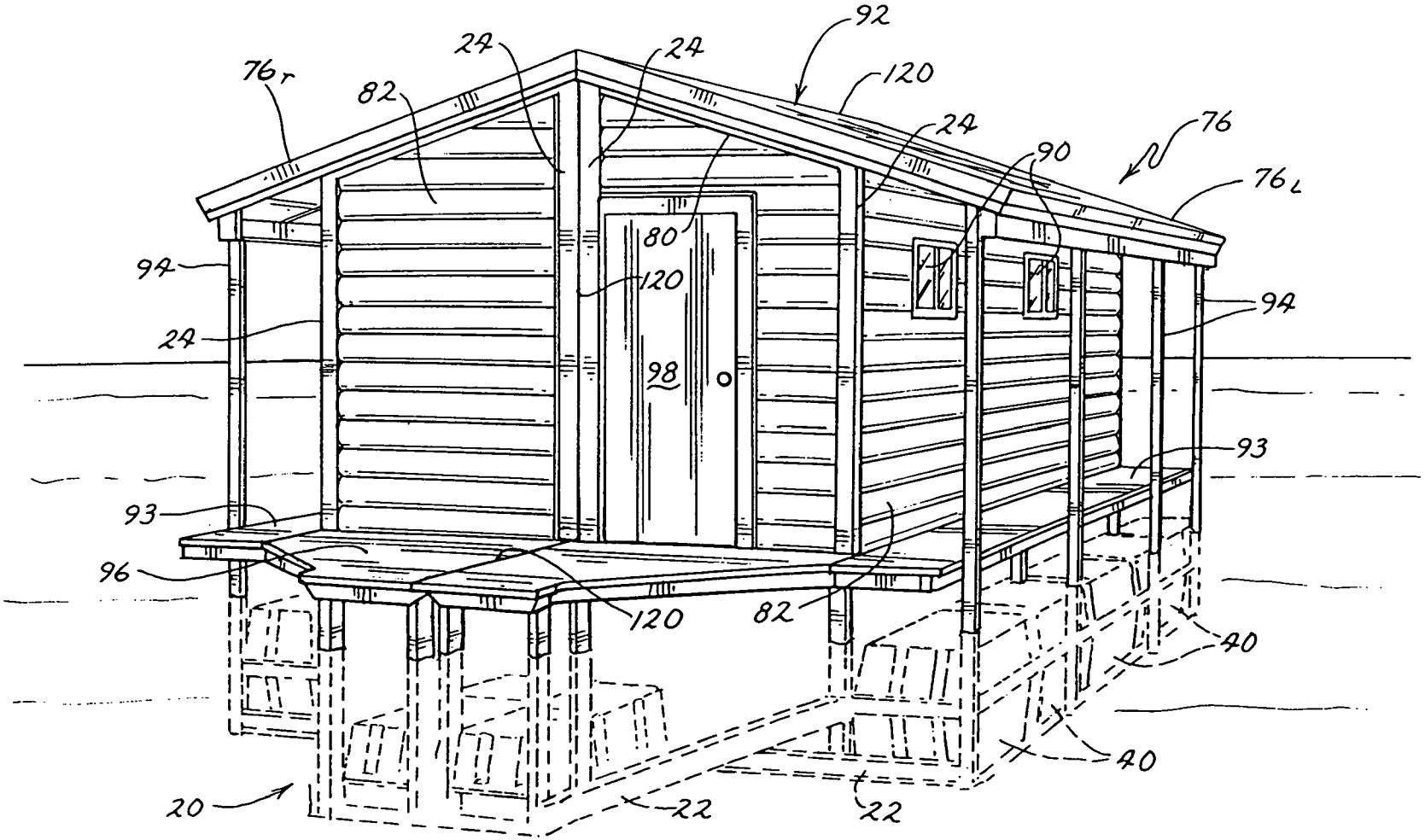
FIG. 22 is a perspective view from the front of another structure according to this invention, particularly illustrating a single story structure comprising an enclosed boathouse having an exterior front landing and exterior left and right side catwalks on either side thereof.

From the perspective of someone inside boathouse 76 looking towards the front end of boathouse 76, boathouse 76 is separable into longitudinal left and right halves $\mathbf{76}_l$ and $\mathbf{76}_r$ along a parting line 120 extending vertically through the entire boathouse 76 along the longitudinal centerline of boathouse 76. Parting line 120 is shown at various spots in the drawings. For example, parting line 120 is shown in FIG. 22 along the center of roof 92, between two adjacent uprights 24 on the front of boathouse 76, and in the center of front landing 96. In FIG. 23, parting line 120 is shown along the center of roof 92 and between transverse headers 80 and sheathing 82 along the rear of boathouse 76. In FIG. 24, parting line 120 is again shown along the center of roof 92 and along floor 102 of work area 100.

There is no similar parting line 120 in cradle 12. Cradle 12 does not split apart into two longitudinal halves.

The purpose of splitting boathouse 76 into two separable halves $\mathbf{76}_l$ and $\mathbf{76}_r$ is to decrease the width of boathouse 76 to ease the task of ground transport of boathouse 76. When boathouse 76 is split into two halves as diagrammatically depicted in FIG. 27, the width of what needs to be towed, namely the width of each boathouse half $\mathbf{76}_l$ or $\mathbf{76}_r$, is only half the overall width of assembled boathouse 76. A pair of wheels 36 (not shown) will be mounted to base 20 of the frame of each boathouse half $\mathbf{76}_l$ or $\mathbf{76}_r$ as described earlier in this specification in conjunction with structure 2 shown in FIGS. 1-8. Each half $\mathbf{76}_l$ or $\mathbf{76}_r$ of boathouse 76 can then be towed separately along a roadway or highway to and from the body of water.

Once boathouse halves $\mathbf{76}_l$ and $\mathbf{76}_r$ arrive at the body of water in which boathouse 76 is to be installed, boathouse 76 halves can be rolled into and then floated on the body of water separately from one other. Each boathouse half $\mathbf{76}_l$ or $\mathbf{76}_r$ can then be towed to the location in the body of water where boathouse 76 is to be installed. In this respect, when towing only one boathouse half $\mathbf{76}_l$ or $\mathbf{76}_r$, an additional ballast tank 40 would be carried on a removable outrigger arm 122 at the open rear end of boathouse 76 to allow proper flotation of the boathouse half $\mathbf{76}_l$ or $\mathbf{76}_r$ on the body of water. See FIG. 29.

When both boathouse halves $\mathbf{76}_l$ and $\mathbf{76}_r$ have arrived at the desired location on the body of water, boathouse halves $\mathbf{76}_l$ and $\mathbf{76}_r$ are abutted together along parting line 120. Boathouse halves $\mathbf{76}_l$ or $\mathbf{76}_r$ are then bolted together to form a single unitary boathouse 76. Outrigger arms 122 with their additional tanks 40 would be removed from the rear end of boathouse 76 to clear the boat entrance 84 in the rear end of boathouse 76. Obviously, boathouse halves $\mathbf{76}_l$ and $\mathbf{76}_r$ could be assembled on land and then towed on the water as a unit in which case outrigger arms 122 and the additional tanks 40 they carry would not be needed. However, it is probably easier to float and tow the boathouse halves $76_l$ and $76_r$ separately and then assemble them together while boathouse halves $76_l$ and $76_r$ are waterborne.

After boathouse 76 is assembled together, boathouse 76 can then be sunk in place as described earlier in conjunction with FIGS. 1-16 by filling tanks 40 with water. When tanks 40 are filled with water and the telescopic legs 52 of boathouse 76 have been extended into contact with the bottom of the body of water, the additional weight provided by ballast system 38 will anchor boathouse 76 in place. Alternatively, the inflatable bladder system of FIG. 17 could be used in place of ballast system 38, though this means that the weight of the fully assembled boathouse 76 by itself when bladders 70 are empty of air must be enough to anchor boathouse 76 in place.

Figure 27:
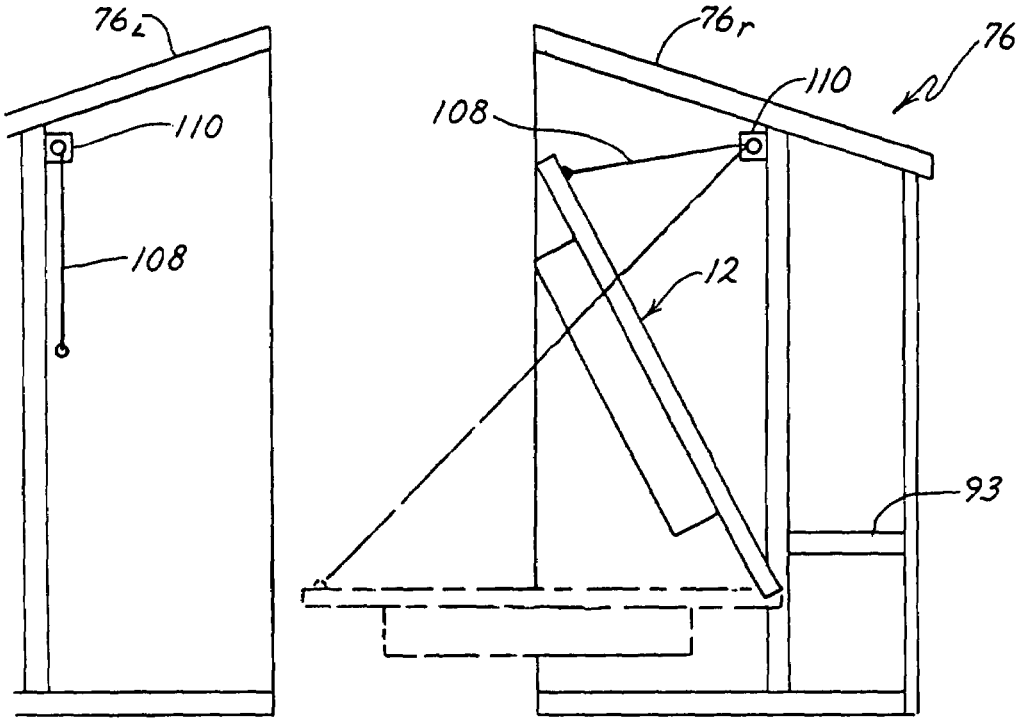
FIG. 27 is a diagrammatic rear elevational view similar to FIG. 26, particularly illustrating the two longitudinal boathouse halves split apart for transport or storage with the boat lifting cradle being held in an inclined storage or transport position within one of the boathouse halves.
Figure 29:
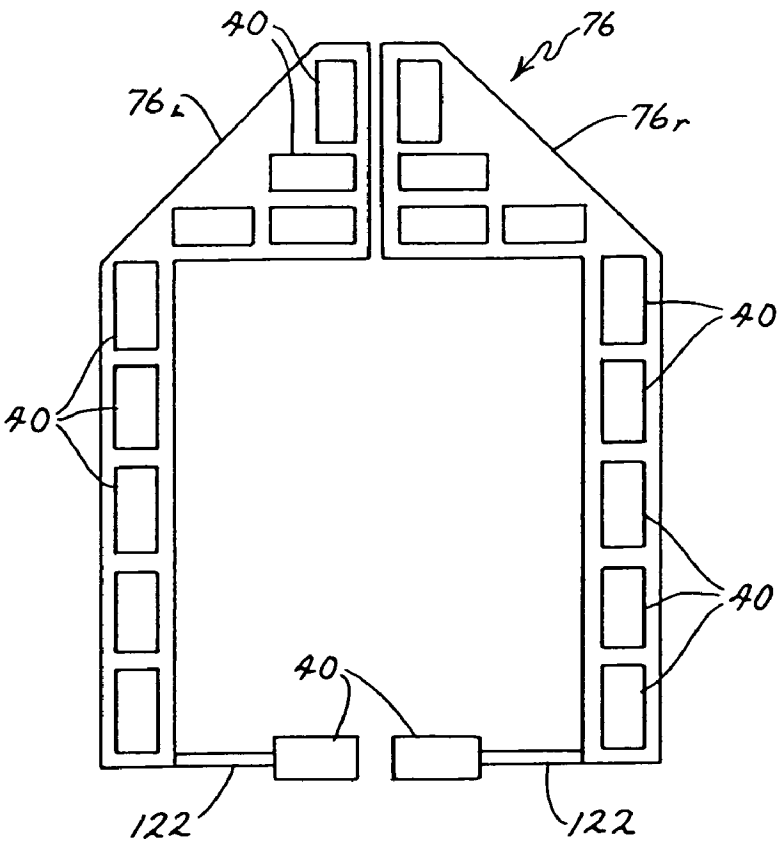
FIG. 29 is a diagrammatic top plan view similar to FIG. 28, but showing the placement of the ballast tanks beneath the front landing and side catwalks of the boathouse along with a pair of removable ballast tanks carried on outrigger arms at the rear of the boathouse.
Figure 28:
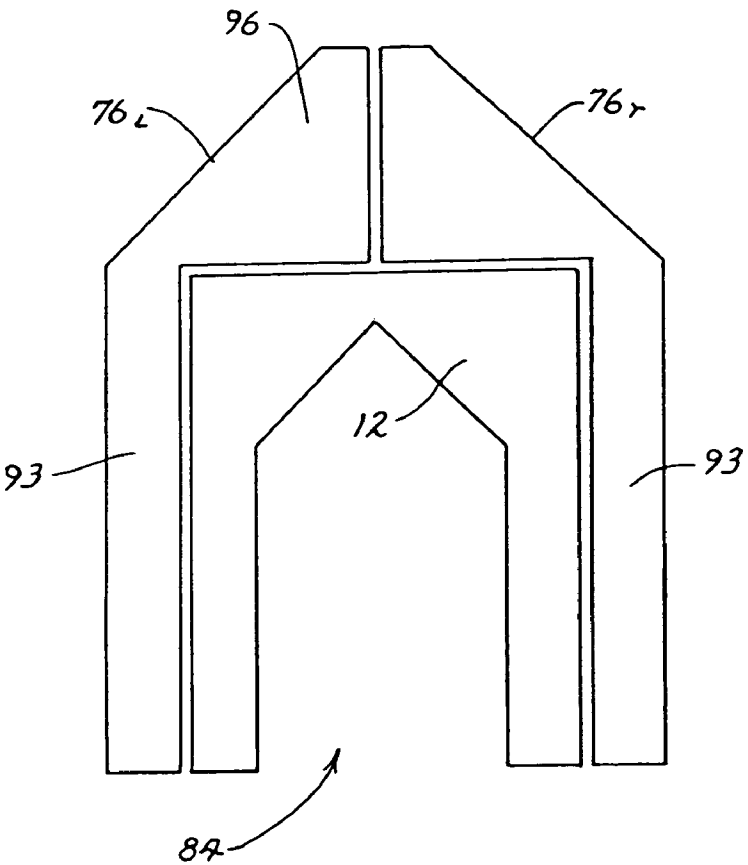
FIG. 28 is a diagrammatic top plan view of the base of the structure shown in FIG. 22, particularly illustrating the two boathouse halves with the unitary boat lifting cradle between them.
Figure 9A:
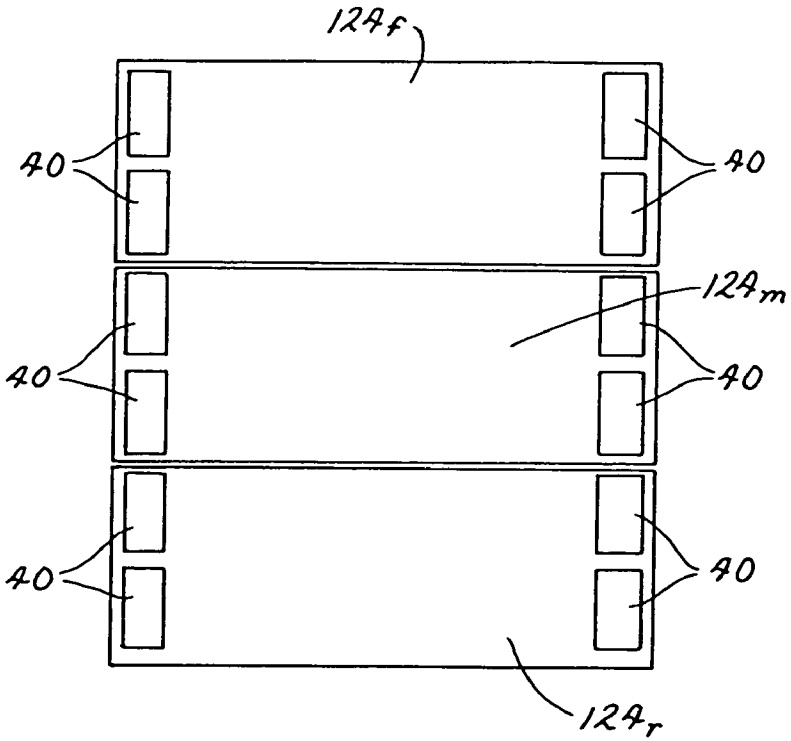
Figure 9B:
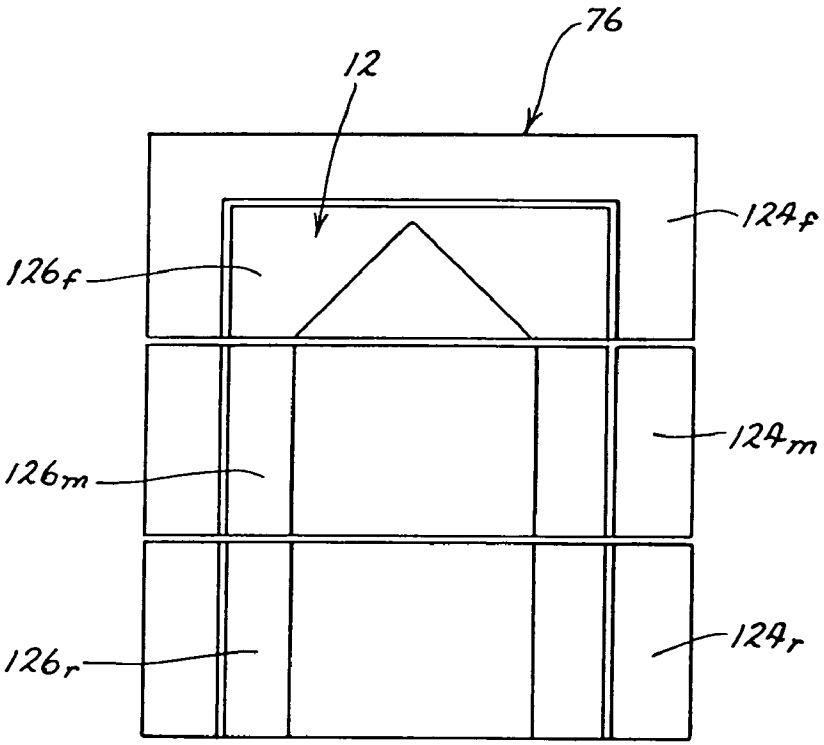

With a unitary cradle 12 in boathouse 76, cradle 12 must be carried by one boathouse half $76_l$ or $76_r$ during transport. This is accomplished as shown in FIG. 27 by unhooking lift cables 108 from one side of cradle 12 and by then crossing over the lift cables 108 from the other side of boathouse 76 to the locations of the unhooked cables 108. This is done after pins or the like are placed beneath cradle 12 to support cradle 12 during the cable unhooking and rehooking. Then, winches 110 of the crossover cables 108 can be operated to pull upwardly on the opposite side of cradle 12 to lift or tilt cradle 12 into an inclined position wholly within one of the boathouse halves $76_l$ or $76_r$. This inclined position is shown in solid lines in FIG. 27. After cradle 12 is so tilted, boathouse halves $76_l$ and $76_r$ can be separated from each other and each half $76_l$ or $76_r$ towed separately as described earlier.

Many counties, cities and municipalities have regulations that prohibit or limit the construction of new enclosed boathouses along a shoreline. Permanent boathouses that were erected before the enactment of such regulations are often grandfathered in and may remain, but new permanent boathouses cannot be built and installed. Boathouse 76 shown in FIGS. 22-29 allows a boathouse to be installed and removed from a body of water in a seasonal manner such that boathouse 76 is not a permanent structure. This is done in the same way as for the other structures 2 of this invention, by using a ballast system 38 or inflatable bladder system to float boathouse 76 or its component halves $76_l$ and $76_r$ to its desired location in the body of water and to then sink boathouse 76 in this location after assembly if need be. Boathouse 76 is separable into halves $76_l$ and $76_r$ to allow easy transport to and removal from the body of water using wheels that are carried on or installed on boathouse halves $76_l$ and $76_r$.

Boathouse 76 represents a secure and protected environment for storing a boat, and is particularly well suited for storing boats of great value, such as classic wooden boats. When front door 98 and boathouse doors 86 are locked, boathouse 76 is substantially enclosed and secure. An intruder would have difficulty in gaining access to boathouse without breaking the locks on doors 98 and 86 or attempting to break through windows 90 or sheathing 82. In addition, access from the water below boathouse 76 is cut off given deck 112 on cradle 12 and the fact that such deck 112 fills in any open space around the boat held within cradle 12. This provides a substantial amount of security and peace of mind for the owner of the boat that is stored within boathouse 76.

Referring now to FIGS. 30 and 31, another alternative for reducing the width of boathouse 76 for transport or storage is to split boathouse 76 into a plurality of transverse modules 124 rather than longitudinal halves $76_l$ or $76_r$. As shown in FIG. 30, boathouse 76 could be split into three such modules 124, comprising a front module $124_f$, a middle module $124_m$, and a rear module $124_r$. In this alternative, cradle 12 of boat lift 8 would also be split into modules 126 contained within each boathouse module 124. Thus, front boathouse module $124_f$ would include a front cradle module $126_f$, middle boathouse module $124_m$ would include a middle cradle module $126_m$, and so on. Cradle modules 126 would lift up and down on vertical guide rails or tracks (not shown) contained in their respective boathouse modules 124.

In this type of boathouse 76, each boathouse module 124 would carry one or more ballast tanks 40 on each side of module 124, again preferably beneath catwalk 93 of module 124. As shown in FIG. 31, each boathouse module 124 has two tanks 40 carried on the left side and on the right side of module 124. This allows each boathouse module 124 to be floated in a balanced fashion on a body of water prior to modules 124 being bolted together to form assembled boathouse 76.

Figure 32:
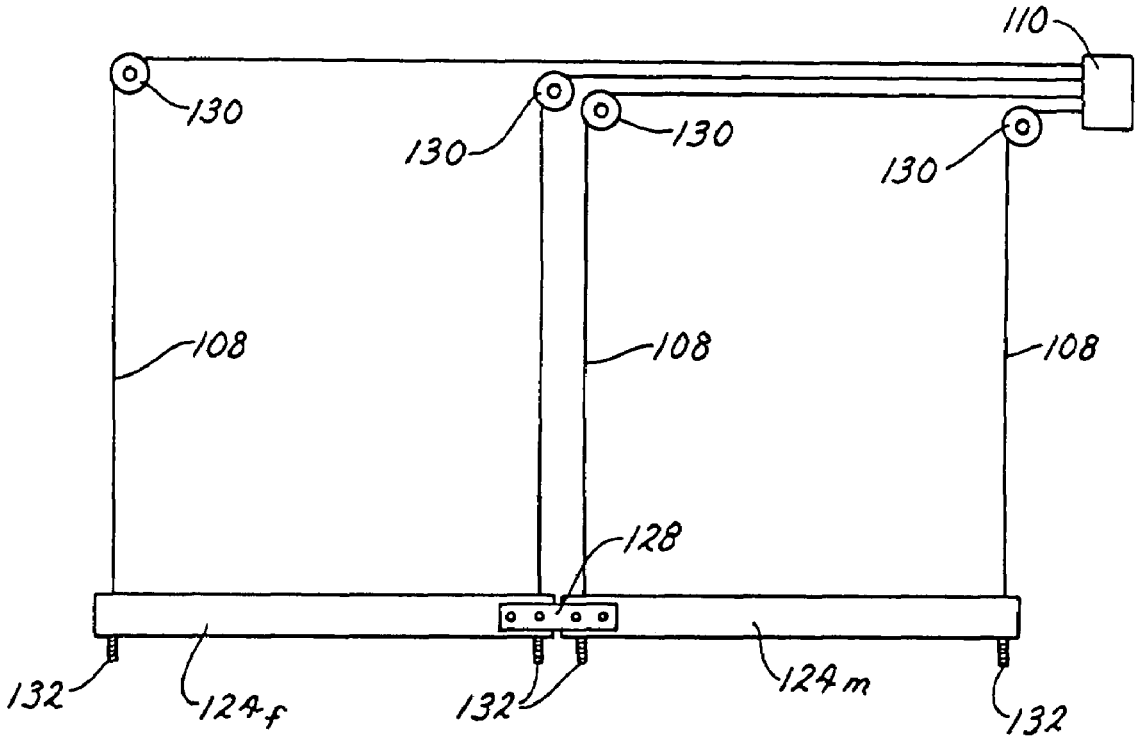
FIG. 32 is a diagrammatic side elevational view of a pair of cradle modules used in the alternative structure shown in FIG. 30, particularly illustrating how the individual cradle modules are linked together end to end and are connected to a common lifting winch to synchronize the movement of the cradle modules.

Because boathouse modules 124 also include individual cradle modules 126, each of which forms a portion of cradle 12, once boathouse modules 124 are assembled together, cradle modules 126 must also be assembled together to move as a unit. One way to do this is to join cradle modules 126 together end to end using connector plates 128. FIG. 32 illustrates the end to end joining of two cradle modules 126, the third cradle module of FIGS. 30 and 31 not being shown in FIG. 32 but being connected similarly. A plurality of lift cables 108 would be attached to the sides of cradle modules 126 and would be directed around a system of pulleys 130 to a common winch 110. Cables 108 would be connected to cradle modules 126 by threaded connectors 132 to allow cradle modules 126 to be leveled relative to one another. When winch 110 is operated, cradle modules 126 will all rise together as a single unitary cradle 12 with their movement being mechanically synchronized through connector plates 128 and the use of a common winch 110 for all lift cables 108.

Alternatively, cradle modules 126 could be left separate from one another and their lift cables 108 could extend up and around separate winches 110. In this case, the movement of cradle modules 126 must be electronically synchronized so that all cradle modules 126 lift together and at the same rate to act as a single unitary cradle 12. This can be done by using shaft encoders on winches 110 and appropriate controls to synchronize winches 110 to one another.

Obviously, for a boathouse 76 that is 30 feet long and 16 feet wide, splitting such a boathouse 76 into three boathouse modules 124 yields modules 124 that are each 10 feet long and 16 feet wide. Each boathouse module 124 when separated from the other modules would be equipped with a pair of wheels 36 (not shown) so that module 124 is towed along the 16 foot width thereof and not along the 10 foot length. Thus, when module 124 is being towed, its towed length is 16 feet but its towed width is only 10 feet. This is easily within all applicable length and width restrictions for towed objects. Once modules 124 reach their intended destination, they can then be abutted with one another and bolted to one another to form assembled boathouse 76.

Another advantage of using transverse boathouse modules 124 rather than longitudinal boathouse halves $76_1$ and $76_r$ is that each module 124 is lighter in weight than a boathouse halve $76_1$ or $76_r$. This would be accentuated even further if boathouse 76 were split into more than three modules 124. After such modules 124 are transported to a body of water, such modules 124 could even be slid or moved while sitting on land to allow modules 124 to be bolted together and assembled while on land.

Boathouse 76 could also be converted to an icehouse in which boat lift 8 is replaced by a substantially solid floor having appropriate fishing holes therein. Such an icehouse could be easily transported to an ice covered lake by towing the icehouse similarly to boathouse 76, i.e. in the various sections thereof comprising longitudinal halves $\mathbf{76}_1$ or $\mathbf{76}_r$ or transverse modules 124. Once the icehouse reaches the lake, it could be easily slid or towed over the surface of the ice since base 20 will engage the ice and keep tanks 40 above the surface of the ice.

In this icehouse conversion of boathouse 76, ballast system 38 represented by tanks 40 functions as a safety system. If the icehouse were to break through the ice, tanks 40 would keep it floating on the surface of the water.

Boathouse 76 is substantially heavier than structures 2 shown in FIGS. 1-16. Boathouse 76 weighs as much as 7,500 pounds or more. When boathouse 76 is towed on the surface of the body of water, tanks 40 are likely to fully submerged. The Applicant has discovered that deformation of tanks 40 can be a problem.

Accordingly, it would be desirable to reinforce tanks 40 to prevent any potential deformation. A suitable internal reinforcement would be placement of crossbracing inside each tank 40. An access hole could be cut in molded plastic tanks 4 and pressure treated 2×4's could be inserted and anchoring in place with stainless steel screws. Alternatively, reinforcement could also be molded directly into the walls of a plastic tank 40.

Preferably, tanks 40 could be made from aluminum. Aluminum tanks 40 could have internal cross bracing welded in place before welding the top of tank 40 in place. External reinforcement could also be used. Such external reinforcement would involve welding the wall of tank 40 to base 20 at key points or by building aluminum tube collars that would be welded around the outside of tank 40. External reinforcement could also involve the use of corrugated material to form the outside walls of tank 40.

If desired, an outboard engine could be mounted to front landing 96, or to a stand connected to front landing 96, to allow boathouse 76 to be self-propelled across a body of water rather than being towed when the buoyancy system is in its buoyant state. Such an engine could be a permanent part of boathouse 76 if desired or can be removed after boathouse 76 has been propelled to a desired location.

Thus, the scope of this invention is to be limited only by the appended claims.

We claim:

1. A structure for use in a body of water, which comprises:

(a) a structure having a length in a fore-and-aft direction between front and rear ends thereof and a width in a side-to-side direction between opposite first and second sides thereof, the structure also having at least one level that includes a weight bearing deck on which people can walk or stand;

(b) at least a pair of wheels that can be at least temporarily attached to the structure to allow the structure to be transported by ground by rolling the structure over the ground; and (c) a ballast system carried on the structure which may be selectively filled with water to add weight to the structure or emptied of water to remove weight from the structure, wherein the ballast system includes:

(i) a first row of a plurality of water receiving and water holding ballast tanks, wherein the first row of ballast tanks extends in the fore-and-aft direction relative to the structure with the first row of ballast tanks being disposed along the first side of the structure; and (ii) a second row of a plurality of water receiving and water holding ballast tanks, wherein the second row of ballast tanks extends in the fore-and-aft direction relative to the structure with the second row of ballast tanks being disposed along the second side of the structure, the ballast tanks in the second row being spaced in the side-to-side direction from the ballast tanks in the first row across the width of the structure.

2. The structure of claim 1, wherein the ballast tanks in the first and second rows thereof are located outboard of the first and second sides, respectively, of the structure.

3. The structure of claim 1, wherein the ballast tanks in the first and second rows thereof are located inboard of the first and second sides, respectively, of the structure.

4. The structure of claim 3, wherein the structure includes a boat lift having a V-shaped boat receiving cradle, and wherein at least some of the ballast tanks in the first and second rows thereof have inner sides with a reduced height compared to outer sides of the tanks to provide clearance relative to the cradle.

5. The structure of claim 1, wherein the ballast tanks in the first and second rows thereof extend in the fore-and-aft direction substantially along the entire length of the structure.

6. The structure of claim 1, further including a plurality of vertically adjustable leveling legs carried on the structure with at least some of the leveling legs being spaced relative to one another in the fore-and-aft direction along the length of the structure.

7. The structure of claim 1, wherein each of the first and second rows of ballast tanks have a pair of end tanks that form opposite ends of each row of ballast tanks, and wherein at least one end tank in each row of ballast tanks has a leading edge shaped to more easily slide through the water than if the leading edge were substantially perpendicular to the water.

8. The structure of claim 7, wherein the leading edge of the at least one end tank in each row of ballast tanks inclines forwardly as it extends upwardly in the manner of a bow of a ship's keel or hull.

9. The structure of claim 7, wherein the leading edge of the at least one end tank in each row of ballast tanks has a rounded nose in the manner of a nose of a bullet or torpedo.

10. The structure of claim 9, wherein a trailing edge of the other end tank in each row of ballast tanks also has a rounded nose in the manner of a nose of a bullet or torpedo.

11. A structure for use in a body of water, which comprises:

(a) a structure having a length in a fore-and-aft direction between front and rear ends thereof and a width in a side-to-side direction between opposite first and second sides thereof, the structure also having at least one level that includes a weight bearing deck on which people can walk or stand;

(b) at least a pair of wheels that can be at least temporarily attached to the structure to allow the structure to be transported by ground by rolling the structure over the ground; and (c) a ballast system carried on the structure which may be selectively filled with water to add weight to the structure or emptied of water to remove weight from the structure, wherein the ballast system includes:

(i) a first water receiving and water holding ballast tank array, wherein the first ballast tank array extends in the fore-and-aft direction relative to the structure with the first ballast tank array being disposed along the first side of the structure;

(ii) a second water receiving and water holding ballast tank array, wherein the second ballast tank array extends in the fore-and-aft direction relative to the structure with the second ballast tank array being disposed along the second side of the structure, the second ballast tank array being spaced in the side-to-side direction from the first ballast tank array across the width of the structure; and (iii) wherein each of the first and second ballast tank arrays have opposite ends, and wherein at least one end in each ballast tank array has a leading edge shaped to more easily slide through the water than if the leading edge were substantially perpendicular to the water.

12. The structure of claim 11, wherein the leading edge of the at least one end in each ballast tank array inclines forwardly as it extends upwardly in the manner of a bow of a ship's keel or hull.

13. The structure of claim 11, wherein the leading edge of the at least one end in each ballast tank array has a rounded nose in the manner of a nose of a bullet or torpedo.

14. The structure of claim 11, wherein each of the first and second ballast tank arrays comprises a single ballast tank.

15. The structure of claim 14, wherein each single ballast tank has a plurality of partial height baffles extending vertically upwardly within an open interior of each single ballast tank.

* * * * *